US006284963B1

(12) United States Patent
Tamura

(10) Patent No.: US 6,284,963 B1
(45) **Date of Patent: *Sep. 4, 2001**

(54) TONE GENERATING METHOD AND DEVICE BASED ON SOFTWARE

(75) Inventor: Motoichi Tamura, Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/752,924

(22) Filed: Nov. 20, 1996

(30) Foreign Application Priority Data

Nov. 22, 1995 (JP) ..... 7-328428
Jan. 17, 1996 (JP) ..... 8-024747

(51) Int. Cl.[7] ..... G10H 7/00
(52) U.S. Cl. ..... 84/603; 84/604
(58) Field of Search ..... 84/603–607

(56) References Cited

U.S. PATENT DOCUMENTS 5,007,323 * 4/1991 Usami ..... 84/604 X
5,038,661 * 8/1991 Kaneko ..... 84/604 X
5,276,273 1/1994 Takauji ..... 84/615
5,283,386 2/1994 Akutsu et al. ..... 84/603
5,317,947 6/1994 Miyata ..... 84/615
5,319,151 6/1994 Shiba et al. .
5,345,035 9/1994 Yamada .
5,376,752 12/1994 Limberis .
5,428,183 6/1995 Matsuda et al. ..... 84/604
5,432,293 7/1995 Nonaka .
5,522,010 * 5/1996 Toyama ..... 84/604 X
5,553,011 * 9/1996 Fujita ..... 84/604 X

FOREIGN PATENT DOCUMENTS 9611315-4 11/1996 (AT) ..... G10H/1/18
6-27955 2/1994 (JP) .

* cited by examiner

*Primary Examiner*—Stanley J. Witkowski
(74) *Attorney, Agent, or Firm*—Morrison & Foerster

(57) ABSTRACT

Tone generating processing is executed on an operating system having no full multitask function. The tone generating processing is activated a plurality of times, i.e., at a plurality of activating times, within each predetermined time period. Thus, even when the tone generating processing fails to be activated at some of the activating times, a predetermined number of samples of tone data can be belatedly formed within the predetermined time period, by tone data forming operations being effected only at the other activating times when the tone generating processing is actually activated. If the predetermined number of samples of tone data can not be formed, just by the tone data forming operations effected only when the tone generating processing is actually activated, for every tone generating channel assigned to the tone generating processing, the number of the tone generating channels to be used for forming the tone data is reduced so as to secure formation of the predetermined number of samples of tone data.

19 Claims, 15 Drawing Sheets

TONE GENERATING METHOD AND DEVICE BASED ON SOFTWARE

BACKGROUND OF THE INVENTION

The present invention relates generally to tone data generating techniques, and more particularly to a method and device which are suitable for causing a general-purpose arithmetic processor, such as a CPU, to execute tone generating processing.

In many electronic musical instruments today, microprocessors are used to execute tone generating processing. In some cases, the microprocessors even execute processing to impart effects to tone data formed through the tone generating processing. It has long been a common practice, in the art, to implement such microprocessors by dedicated hardware (for example, tone generator LSI or DSP) having a circuit structure depending on a particular tone generating method employed (for example, waveform memory or FM synthesis method).

However, thanks to the recent improvement of CPU's computing capability, electronic musical instruments have appeared where the CPU loaded in a general-purpose computer or dedicated tone generating device is programmed to execute necessary tone generating processing. Here, such a tone generating device or method will be called a "software tone generator", while the traditional tone generating device or method will be called a "hardware tone generator".

In the software tone generator, the CPU must concurrently execute the tone generating processing and various other processing. Thus, in cases where a general-purpose computer is used to implement the software tone generator, it is desirable to carry out the tone generating processing on an operating system having a multitask function (e.g., Windows 95 (trademark) of Microsoft Corporation) in order to assure that the tone generating processing is executed without being influenced by the other processing.

But, in fact, operating systems having no multitask function (e.g., Windows 3.1 (trademark) of Microsoft Corporation) are widely used today, and there is a great need for the tone generating processing to be executed on such operating systems. With these operating systems, the execution of the tone generating processing tends to be often delayed by an influence of the other processing, which could result in a significant hindrance to the tone generation.

SUMMARY OF THE INVENTION

It is therefore an object of the present invention to provide a tone generating device and method based on a software tone generator which effectively prevent a hindrance to tone generation even when tone generating processing is executed on an operating system having no full multitask function.

In order to accomplish the above-mentioned object, the present invention provides a tone generating device which comprises: a supply section for supplying performance information; an activating section for activating tone generating processing based on the performance information a plurality of times within a predetermined time period; a tone generating section for executing the tone generating processing activated by the activating section; and a control section for controlling the tone generating processing executed by the tone generating section, in such a manner that a predetermined number of samples of tone data can be belatedly formed within the predetermined time period by tone data forming operations being effected only when the tone generating processing is actually activated by the activating section.

In addition, the present invention provides a tone generating method for causing general-purpose arithmetic processing section to execute tone generating processing on the basis of supplied performance information, which comprises: a first step of activating the tone generating processing a plurality of times within a predetermined time period; a second step of performing control over the tone generating processing in such a manner that a predetermined number of samples of tone data can be belatedly formed within the predetermined time period by tone data forming operations being effected only when the tone generating processing is actually activated by the first step; and a third step of executing the tone generating processing activated by the first step in accordance with the control by the second step.

Software tone generators are known which are designed to form a predetermined number of samples of tone data every predetermined time period and later reproduce all the formed tone data together. Generally, in such a software tone generator, tone generating processing is activated only once (at only one activating time) in each predetermined time period to form the predetermined number of samples of tone data for the time period. However, where an operating system of the software tone generator does not have a full multitask function, the tone generating processing may fail to be activated at the activating time or tends to be activated behind the activating time due to an influence of other processing. Thus, operations to form the predetermined number of samples of tone data can sometimes not be completed within the predetermined time period, which would cause a significant hindrance to the necessary tone generation.

According to the tone generating device and method of the present invention arranged in the above-mentioned manner, however, the tone generating processing is activated a plurality of times (i.e., at a plurality of activating times) within each predetermined time period. Thus, even when the tone generating processing fails to be activated at some of the activating times, the predetermined number of samples of tone data can be formed in a suitable manner within the predetermined time period, by the tone data forming operations being effected belatedly only at the other activating times when the tone generating processing is actually activated. This arrangement reliably prevents a hindrance to the tone generation.

If the tone generating processing fails to be activated at many of the activating times, there may arise a situation where the predetermined number of samples of tone data can not be formed, just by the tone data forming operations effected only when the tone generating processing is actually activated, for every tone generating channel assigned to the tone generating processing. In such a case, the number of the tone generating channels to be used for forming the tone data is reduced so as to secure formation of the predetermined number of samples of tone data.

The present invention also provides a tone generating device which comprises a supply section for supplying performance information; a first register for, when tone generating processing based on the performance information is assigned to an unused tone generating channel, storing therein a parameter for controlling the tone generating processing; a second register for, when new tone generating processing based on other performance information is assigned to the tone generating channel while the channel is not available for the new tone generating processing, storing therein a parameter for controlling the new tone generating processing; a selecting section for selecting the first register before a predetermined time point to start the new tone generating processing and selecting the second register after the predetermined time point; and a tone generating section for generating tone data in the tone generating channel by use of one of the first and second registers selected by the selecting section.

In addition, the present invention provides a tone generating method for causing general-purpose arithmetic processing section to execute tone generating processing on the basis of supplied performance information, which comprises a first step of assigning tone generating processing to an unused tone generating channel and storing a parameter for controlling the tone generating processing into a first register; a second step of, when new tone generating processing is assigned to the tone generating channel while the channel is not available for the new tone generating processing, storing a parameter for controlling the new tone generating processing into a second register; a third step of selecting the first register before a predetermined time point to start the new tone generating processing and selecting the second register after the predetermined time point; and a fourth step of generating tone data in the tone generating channel by use of one of the first and second registers selected by the third step.

In the known software tone generator, if the tone generating processing fails to be activated at the activating time or is activated behind the activating time due to an influence of other processing, the interval between a time when performance information is supplied and a time when the tone generating processing based on performance information is later started will become longer. As a result, there may arise a situation where many of the tone generating channels can not initiate the tone generating processing with their associated registers having stored therein parameters for controlling the processing. If new tone generating processing based on newly supplied performance information is assigned to any of such channels still in use for the current tone generating processing, parameters for controlling the new tone generating processing can not be accepted into the associated register for a long time until the current tone generating processing is completed in the channel; namely, the new tone generating processing can not be prepared in the channel. Thus, even if the tone generating processing activation takes place during such a time, the new tone generating processing can not be executed in that tone generating channel, which would even further delay the tone data forming operations.

According to the tone generating device and method of the present invention arranged in the above-mentioned manner, however, when new tone generating processing based on newly supplied performance information is assigned to any of such channels that is still in use for the current tone generating processing and hence unavailable for the new tone generating processing, the new tone generating processing in the channel can be immediately prepared in the second register while securing continued execution of the current tone generating processing in the channel using the first register. This arrangement can reliable prevent an undesirable delay in the tone data formation due to the delayed preparation of the new tone generating processing.

The present invention further provides a tone generating device which composes: a supply section for supplying performance information; a plurality of output buffers for writing therein tone data; a reserving section for reserving reproduction from one or more of the output buffers prior to execution of tone generating processing; a tone generating section for generating tone data on the basis of the performance information, writing the generated tone data into any of the output buffers other than the buffers reserved by the reserving section, and reserving reproduction from the output buffer having the generated tone data written therein; and a reproducing section for reading the output buffers in order in which the reproduction has been reserved.

In addition, the present invention provides a tone generating method for causing general-purpose arithmetic processing section to execute tone generating processing on the basis of supplied performance information, which comprises a first step of reserving reproduction from one or more output buffers for writing therein tone data, prior to execution of tone generating processing; a second step of generating tone data, writing the generated tone data into any of the output buffers other than the buffers reserved by the first step, and reserving reproduction from the output buffer having the generated tone data written therein; and a third step of performing control to read the output buffers in order in which the reproduction has been reserved.

In the known software tone generator, if tone generating processing is activated behind a predetermined time due to an influence of other processing, reproduction of tones would be delayed and the tone generation would be greatly hindered.

According to the tone generating device and method of the present invention arranged in the above-mentioned manner, however, even when the tone generating processing fails to be activated within a predetermined time period, tones can be reproduced with no unwanted break as long as the tone generating processing is activated and reproduction from any of the output buffers is made before reproduction from all the reserved output buffers is completed. This arrangement can effectively expand a tolerable range of time delay, in the activation of the tone generating processing, that prevents an unwanted break in a stream of generated tones.

The present invention further provides a tone generating device which comprises a supply section for supplying performance information; an output buffer for writing therein tone data; a tone generating section for generating tone data on the basis of the performance information, writing the generated tone data into the output buffer, and reserving reproduction from the the output buffer; a reproducing section for reading the output buffer in order in which the reproduction has been reserved; and a renewing section for, when the reproduction from the output buffer is not reserved in the reproducing section within a predetermined time period, discontinuing forming operations of tone data that should have been completed by the tone generating section by the time period and thereby causing the tone generating section to newly start forming operations of other tone data to be formed after the time period.

In addition, the present invention provides a tone generating method for causing general-purpose arithmetic processing section to execute tone generating processing on the basis of supplied performance information, which comprises a first step of generating tone data, writing the generated tone data into an output buffer, and reserving reproduction from the the output buffer; a second step of reading the output buffer in order in which the reproduction has been reserved by the first step; a third step of, when the reproduction from the output buffer is not reserved within a predetermined time period, discontinuing forming operations of the tone data that should have been completed by the time period and thereby newly starting forming operations of other tone data after the time period.

According to the tone generating device and method of the present invention arranged in the above-mentioned manner, in case reproduction from any output buffer is not reserved within a predetermined time period, the tone generating processing is renewed so that even when the reproduction reservation can not be made in time and a temporary disturbance is caused in the tone generation, stable tone generation can be immediately restored and hence accompanying noise can be minimized.

The present invention further provides a tone generating device which comprises a supply section for supplying performance information; an activating section for activating tone generating processing based on the performance information, at a plurality of points within a predetermined time period; a tone generating section for executing the tone generating processing activated by the activating section; and a control section for performing control such that when the tone generating processing is activated at any one of the point by the activating section, a number of samples of tone data to be formed through the tone generating processing is caused to follow a predetermined target value set for the point.

In addition, the present invention provides a tone generating method for causing general-purpose arithmetic processing section to execute tone generating processing on the basis of supplied performance information, which comprises a first step of activating tone generating processing at a plurality of points within a predetermined time period; a second step of performing control such that when the tone generating processing is activated at any one of the point by the first step, a number of samples of tone data to be formed through the tone generating processing is caused to follow a predetermined target value set for the point; and a third step of executing the tone generating processing activated by the first step in accordance with the control by the second step.

According to the tone generating device and method of the present invention arranged in the above-mentioned manner, each time the tone generating processing is activated, control is performed such that tone forming operations are performed up to a specific number of samples of tone data for that activating time as a target value. Thus, a predetermined number of samples of tone data can be formed within the predetermined time period by tone data forming operations being effected only when the tone generating processing is actually activated. The target value is preferably set to allow the forming operations of the predetermined number of samples of tone data to be completed within the time period, but need not necessarily be set to such a value. Namely, in the case where reproduction from output buffers is made prior to execution of the tone generating processing as in the previously-mentioned arrangement, the target value may be set such that if formation of the predetermined number of samples of tone data is not completed within the time period, tone data left unformed in that time period can be belatedly formed in the next predetermined time. In short, the target value only needs to be set to guarantee such a tolerable range of time delay in activating the tone generating processing that does not cause an unwanted break in a stream of generated tones.

In some specific forms of the tone data forming control of the present invention, a time delay in the tone generating processing may be accommodated by adding all left-unformed tone data (all tone data that failed to be formed at a particular activating time) to the number of samples to be formed in response to next activation of the processing, or by increasing the number of samples to be formed in response to each subsequent activation by a uniform quantity or by a quantity proportional to the number of the left-unformed tone data.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
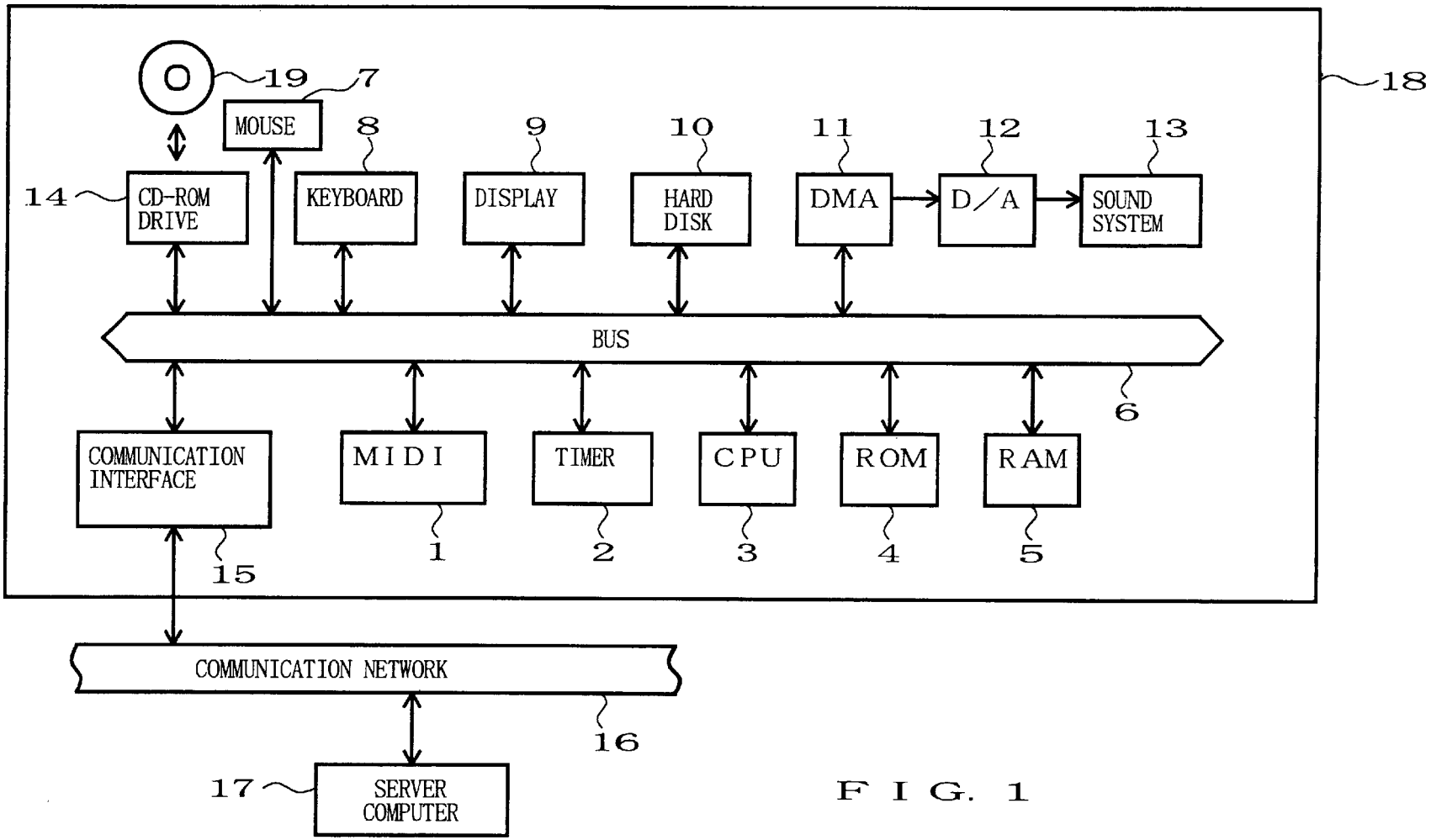
FIG. 1 is a block diagram illustrating a general structure of a computer music system to which is applied the principle of the present invention.

FIG. 1 is a block diagram illustrating a general structure of a computer music system 18 based on a software tone generator according to the present invention, in which a CPU 3 of a personal computer executes tone generating processing as will be described later in detail.

To the CPU 3 are connected, via a data and address bus 6, a MIDI interface 1, a timer 2, a ROM (read-only memory) 4, a RAM (random-access memory) 5, a mouse 7, a keyboard 8, a display 9, a hard disk device 10 and a DMA (direct memory access) controller 11.

The DMA controller 11 executes a reproduction process, in which it uses the known direct memory access method to sequentially read out, from an output buffer of the RAM 5, tone data formed by the CPU 3 executing the tone generating processing and then sends the read-out tone data to a D/A (DAC: digital-to-analog) converter 12, sample by sample, in synchronism with reproduction sampling clock pulses from the converter 12. Each of the tone data converted via the D/A converter 12 into analog representation is audibly reproduced via a sound system 13 comprised of amplifiers and speakers.

The hard disk device 10 has prestored thereon various software programs such as OS (in this embodiment, Windows 3.1 (Microsoft's trademark)) and utility software programs, as well as waveform data of a plurality of tone colors for one or more periods.

The programs to be executed by the CPU 3 may be prestored in the ROM 4 rather than on the hard disk 10, there may be stored various other data than the waveform data. By loading any of the programs from the hard disk 10 or ROM 4 into the RAM 5, the CPU 3 can execute the program. This greatly facilitates version-up, addition, etc. of an operating program. A CD-ROM (compact disk) 19 may be used as a removably-attachable external recording medium for recording various data and an optional operating program. Such an operating program and data stored in the CD-ROM 19 can be read out by means of a CD-ROM drive 14 to be then transferred for storage on the hard disk 10. This facilitates installation and version-up of the operating program. The removably-attachable external recording medium may be other than the CD-ROM, such as a floppy disk and magneto optical disk (MO).

A communication interface 15 may be connected to the bus 6 so that the computer music system 18 can be connected via the interface 15 to a communication network 16 such as a LAN (local area network), internet and telephone line network and can also be connected to an appropriate sever computer 17 via the communication network 16. Thus, where the operating program and various data are not stored on the hard disk 10, these operating program and data can be received from the server computer 17 and downloaded onto the hard disk 10. In such a case, the computer music system 18, i.e., a "client", sends a command requesting the server computer 17 to download the operating program and various data by way of the communication interface 15 and communication network 16. In response to the command from the computer music system 18, the server computer 17 delivers the requested operating program and data to the system 18 via the communication network 16. The computer music system 18 completes the necessary downloading by receiving the operating program and data via the communication network 15 and storing these onto the hard disk 10.

It should be understood here that the computer music system 18 of the present invention may be implemented by installing the operating program and various data corresponding to the operations of the present invention in a commercially available personal computer. In such a case, the operating program and various data corresponding to the operations of the present invention may be provided to users in a recorded form in a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Figure 2:
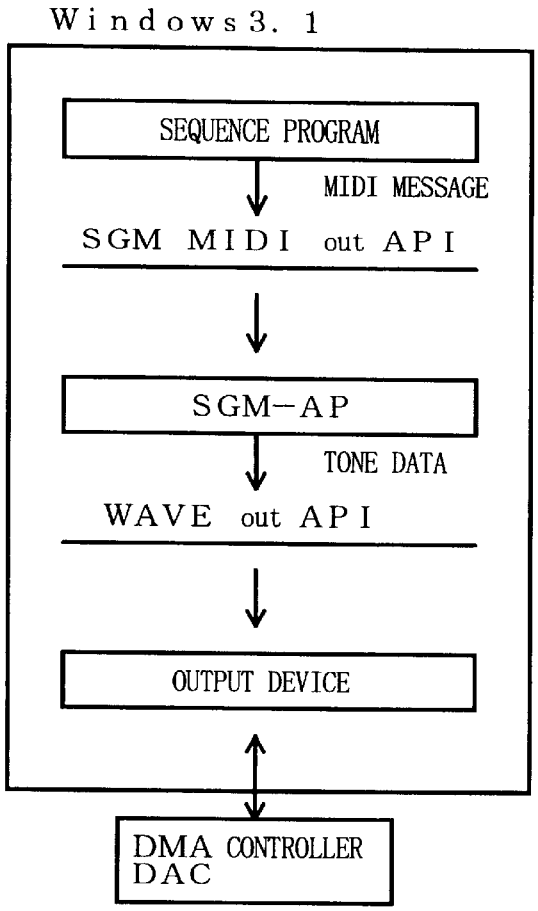
FIG. 2 is a diagram illustrating an exemplary software configuration of a software tone generator employed in the computer music system of FIG. 1.

FIG. 2 is a diagram illustrating an example configuration of software used for implementing the software tone generator (tone generating software). To minimize the programming complexity, this tone generating software is hierarchically organized as a composite of minimum units (modules) that are programmable independently of each other. Specifically, a "sequencer program" at a highest level of the hierarchy is a module for creating MIDI messages which is in the form of an application software program (for example, a sequencer, game or karaoke software program).

An interface "SGM MIDI out API" is a sort of application programming interface provided in the software tone generator for conducting information communication between the modules.

Figure 3:
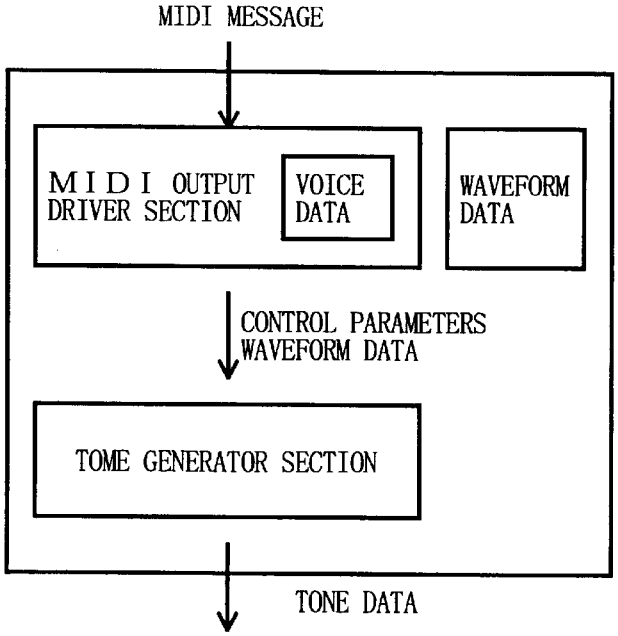
FIG. 3 is a diagram illustrating an exemplary configuration of an interface "SGM-AP" of FIG. 2.

Another interface "SGM-AP" at a lower level of the hierarchy is a program for generating tone data on the basis of the MIDI message supplied from the sequencer program via the interface SGM MIDI out API. As shown in FIG. 3, this tone data generating program SGM-AP is comprised of a MIDI output driver section and a tone generator (or engine) section. The MIDI output driver section is a module for driving the tone generator section, which is responsive to the MIDI message to convert voice data into control parameters to control the tone generator section. The control parameters are sent to the tone generator section via an inter-module interface (not shown). When the MIDI output driver section is initialized, waveform data are loaded in from a file and sent to the tone generator section via the inter-module interface, so that the tone generator section generates tone data using the waveform data and in accordance with the control parameters.

Referring back to FIG. 2, an interface "WAVE out API" is a sort of application programming interface provided in Windows 3.1 (Microsoft's trademark). "Output device" is a module for outputting to the D/A converter 12 tone data supplied from the program SGM-AP via the interface WAVE out API. In this computer music system, as earlier noted, the DMA controller 11 sends the tone data to the D/A converter 12 in the direct memory access method. Thus, the output device is activated by an interrupt signal from the DMA controller 11 under the control of the CPU 3.

Figure 4:
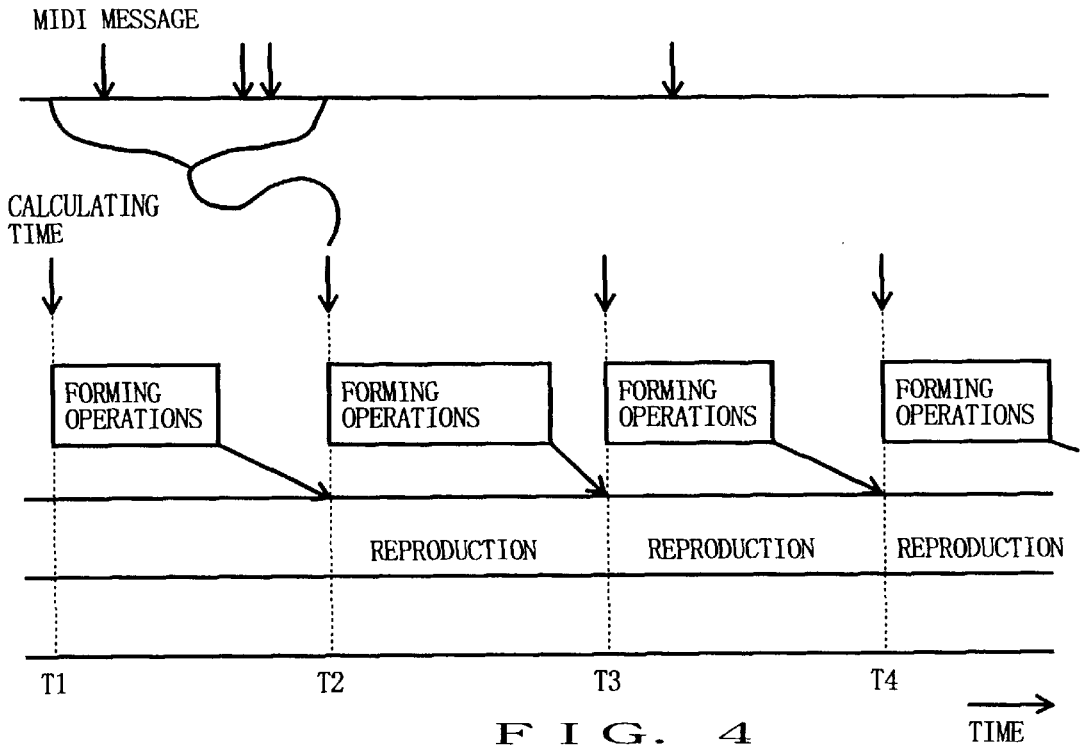
FIG. 4 is a diagram illustrating exemplary operations by the software of FIG. 2.

Processing based on the software as shown in FIG. 2 will be outlined below with reference to FIG. 4. Upon start-up of the sequencer program, supply of MIDI messages is started, in response to which the MIDI output driver section is activated to convert voice data into control parameters and store the converted control parameters and other data into a tone generator register for every tone generating channel assigned to tone generation based on the MIDI messages.

The tone generator section of FIG. 3 is activated, every predetermined time period of predetermined length (hereinafter referred to as a "frame"), to execute tone generating processing based on the MIDI messages supplied within a preceding frame in accordance with the control parameters. For example, as shown in FIG. 4, the tone generating processing based on MIDI messages supplied within a frame from time T1 to time T2 is executed within a next frame from time T2 to time T3. In a preferred example of the tone generating processing based on the waveform memory method, for each tone generating channel assigned to tone generation, waveform data are read out from the RAM 5 at a rate as dictated by the control parameters stored in the tone generator register for that channel, and the read-out waveform data are subjected to color control (filter operation), volume control (multiplication by tone volume envelope data) and modulation control of pitch, color, volume, etc. in accordance with the control parameters. In this manner, a predetermined number of samples of tone data are formed for the tone generating channel. The formed tone data of the assigned tone generating channels are accumulated and then written into an output buffer of the RAM 5. In some case, the accumulated tone data may be imparted effects before being written into the output buffer. Then, reproduction from the output buffer is reserved in the output device.

For each of the frames, the output device reads out the formed tone data, sample by sample, from the output buffer reserved in the preceding frame and sends the read-out tone data to the D/A converter 12. In the example of FIG. 4, tone data formed within a frame from time T2 to time T3 are read out from the reserved output buffer in a frame from time T3 to time T4.

In the above-mentioned software, activation of the sequencer program and activation of the MIDI output driver section based on the supplied MIDI message are effected in real time. The output device is activated compulsorily by an interrupt signal from the DMA controller 11, so that no time delay would result. In contrast, the tone generator section is activated by an internal interrupt signal from the CPU 3 itself; thus, when the software is run on an operating system with no full multitask function, the activation of the tone generator section would be delayed by an influence of other processing, so that desired tone generation could be hindered significantly. The computer music system of the present invention is constructed to effectively prevent such a hindrance to the tone generation, by some measures that will be outlined below.

Measure 1

According to this measure, generation of the internal interrupt signal activating the tone generator section occurs a plurality of times (i.e., at a plurality of activating times) within each frame. By forming some of the predetermined number of samples of tone data (to be written in one output buffer) each time the tone generator section is activated by the signal, appropriate adjustment is made such that the predetermined number of tone data to be written in one output buffer can be belatedly formed within the frame in a distributed manner.

In the event that the tone generator section is not activated at one of the points and hence no tone data is formed because no internal interrupt signal is generated, appropriate adjustment is made such that arithmetic forming operations of tone data to be written in one output buffer can be assured, by forming the left-unformed tone data (i.e., tone data that failed to be formed at the activating time) when another internal interrupt signal is generated at another activating time in the frame.

According to Measure 1, the above-mentioned hindrance to the tone generation can be effectively avoided, because generation of the internal interrupt signal activating the tone generator section occurs a plurality of times within each frame and the predetermined number of tone data can be completely formed by just tone data forming operations being effected only when the tone generating processing is actually activated by the internal interrupt signal.

Figure 5:
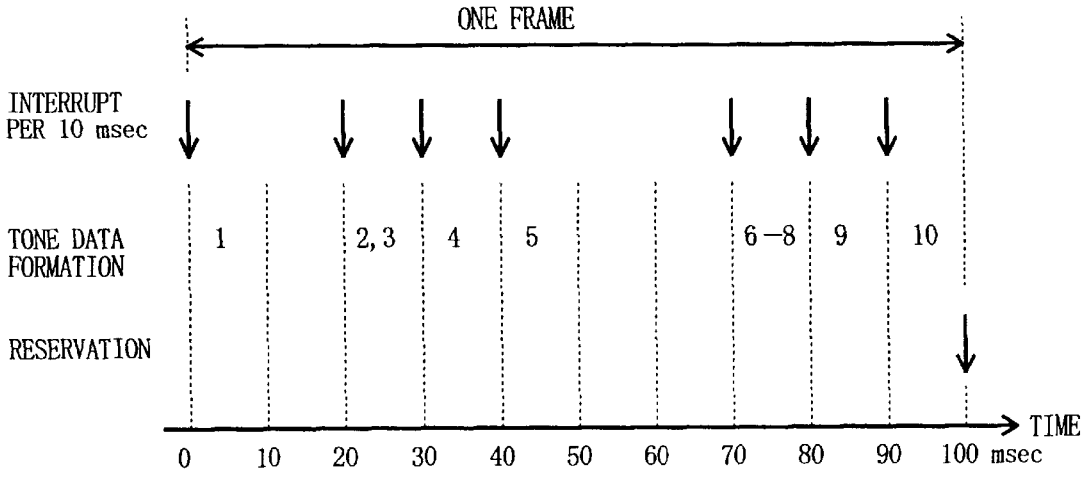
FIG. 5 is a diagram explanatory of an example of Measure 1.
Figure 6:
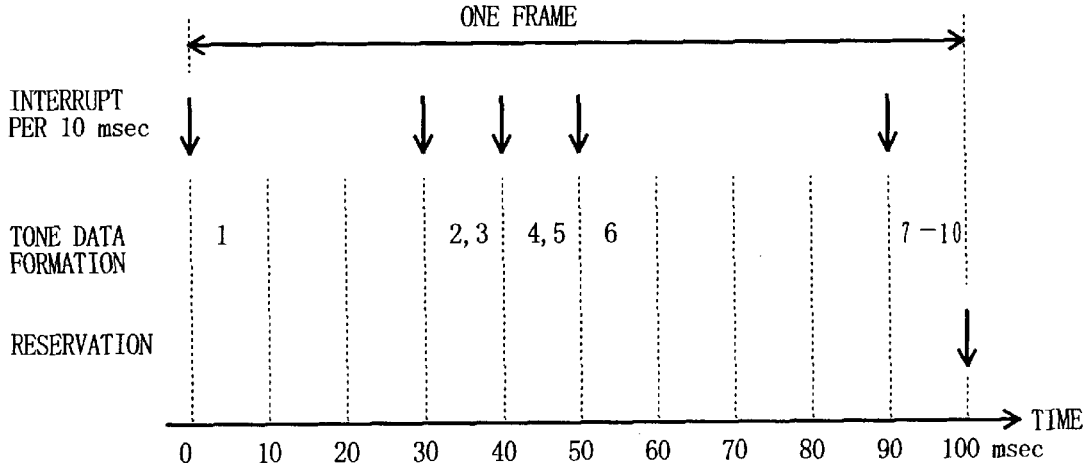
FIG. 6 is a diagram explanatory of another example of Measure 1.

FIGS. 5 and 6 are explanatory of examples of Measure 1, according to which internal interrupt signals activating the tone generator section are generated in a frame of 100 milliseconds at intervals of 10 milliseconds (hence, 10 internal interrupt signals are generated per frame) and one tenth of the predetermined number of tone data is formed each time the tone generator section is activated by the interrupt signal.

In the example of FIG. 5, all tone data that failed to be formed due to a failure of the internal interrupt signal generation are belatedly formed in response to generation of a next internal interrupt signal. Namely, in the illustrated example, all tone data that failed to be formed due to a failure of the internal interrupt signal generation at the second interrupt or activating time (corresponding to 10th millisecond point in the figure) are formed, in response to the internal interrupt signal generated at the third activating time (corresponding to 20th millisecond point), together with tone data originally allocated to that point (as denoted by "2" and "3" in the figure). Also, all tone data that failed to be formed due to a failure of the internal interrupt signal generation at the sixth and seventh activating times (corresponding to 50th and 60th millisecond points) are formed, in response to the internal interrupt signal generated at the eighth activating time (corresponding to 70th millisecond point), together with tone data originally allocated to that point (as denoted by "6–8" in the figure).

In the example of FIG. 6, on the other hand, all tone data that failed to be formed due to a failure of the internal interrupt signal generation are belatedly formed in a distributed fashion at a plurality of subsequent activating times when internal interrupt signals are actually generated. Namely, all tone data that failed to be formed due to a failure of the internal interrupt signal generation at the second and third activating times (corresponding to 10th and 20th millisecond points) are formed later, in response to the internal interrupt signals actually generated at the fourth and fifth activating times (corresponding to 30th and 40th millisecond points), together with tone data originally allocated to that point (as denoted by "2", "3" and "4", "5" in the figure). However, at the last or 10th activating time (corresponding to 90th millisecond point), all tone data that failed to be formed due to a failure of the internal interrupt signal generation at the seventh, eighth and ninth activating times (corresponding to 60th, 70th and 80th millisecond points) are formed together in order to assure formation of the predetermined number of tone data (to be written in one output buffer) within the frame.

While in the example of FIG. 6, all tone data that failed to be formed due to the failure of the internal interrupt signal generation, i.e., left-unformed tone data, are formed in a distributed fashion at one or more activating subsequent times in a predetermined quantity, these left-unformed tone data may be formed later in optional different quantities (e.g., the predetermined number, one and half of the predetermined number and half of the predetermined number.)

As another example, all the left-unformed tone data resulting from the failure of the internal interrupt signal generation may be formed progressively by the end of the last or 10th activating time within the same frame.

If the left-unformed tone data occur at many activating times, arithmetic forming operations of tone data for every assigned tone generating channels might not be completed at one or more subsequent activating times where the interrupt signal is actually generated. Therefore, in Measure 1, it is desirable that generation of all the tone data be achieved by reducing the number of the tone generating channels to be used for the tone data formation. The number of such tone generating channels to be reduced is the greatest in the example of FIG. 5; in the case of FIG. 6 and in other cases where the left-unformed tone data are formed progressively by the end of the last activating time, the number of the tone generating channels to be reduced is smaller than that of the FIG. 5 example (the example of FIG. 5 is most desirable if the left-unformed tone data are to be formed promptly).

Measure 2

According to this measure, there are provided, as the tone generator register for each of the tone generating channels, a first register (primary tone generator register) for storing parameters to control current tone generating processing assigned when the channel is not in use or available, and a second register (secondary tone generator register) for storing parameters to control new tone generating processing assigned when the channel is still in use for the current tone generating processing and hence unavailable for the new tone generating processing. As the tone generator register to be used for the tone generating channel, the primary tone generator register is selected before the new tone generating processing is to start, and the secondary tone generator register is selected after the new tone generating processing has started.

With such Measure 2, when new tone generating processing is assigned to one of the tone generating channels still in use for the current tone generating processing, the new tone generating processing can be immediately furnished or prepared in the secondary tone generator register while securing continued execution of the current tone generating processing. In this way, it is possible to prevent any time delay in the tone data formation resulting from a time delay in preparing the new tone generating processing.

Measure 3

According to this measure, a plurality of output buffers are provided in the RAM 5, and reproduction from some of the output buffers is reserved in the output device prior to the activation of the tone generator section. Even when the tone generator section is prevented from being duly generated at a predetermined activating time due to an influence of the other processing, tones can be reproduced with no break in a stream of generated tones as long as the the tone generator section is activated and reproduction from another output buffer is reserved before the previously-reserved reproduction from the output buffers is completed. Thus, this measure expands such a tolerable range of time delay in the activation of the tone generator section that can prevent a break in a stream of generated tones.

Figure 7:
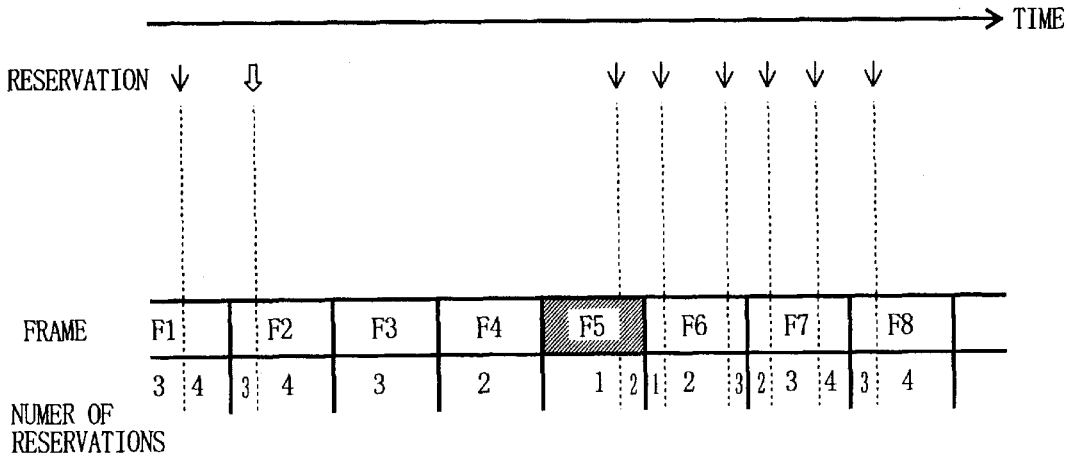
FIG. 7 is a diagram explanatory of an example of Measure 3.

FIG. 7 is a diagram explanatory of exemplary details of Measure 3, according to which reproduction from four output buffers is reserved in the output device prior to the activation of the tone generator section. The number of reserved output buffers at the start of frame F1 is "3" now that reproduction from one output buffer has been completed at the preceding frame, but during frame F1, the number of reserved output buffers is increased to "4" because formation of the predetermined number of tone data to be written in one output buffer has been completed and reproduction from the output buffer has been reserved. Then, the number of reserved output buffers is decreased to "3" after frame F1 now that reproduction from another output buffer has been completed, but during frame F2, the number of reserved output buffers is again increased to "4" because formation of the predetermined number of tone data to be written in the next output buffer has been completed and reproduction from the output buffer has been reserved.

After that, the number of reserved output buffers is decreased to "1" after frame F4 because no tone data is formed due to a time delay in the activation of the tone generator section. Then, in frame F5, tone data are reproduced from the last one of the reserved output buffers (i.e., the output buffer reserved during frame 2); occurrence of the reproduction reservation in frame 2 is denoted by white arrow, while the reproduction in frame F5 is denoted by half-tone dot meshing. During frame F5, the number of reserved output buffers is increased to "2" because formation of the predetermined number of tone data to be written in one output buffer has been completed and reproduction from the output buffer has been reserved. Similarly, after frame 5, the number of reserved output buffers is increased and decreased in response to completion of the reproduction and occurrence of the reproduction reservation.

In the above-mentioned manner, even when the tone generator section fails to be duly generated at a predetermined activating time due to an influence of the other processing, tones can be appropriately reproduced with no break as long as the the tone generator section is activated and reproduction from another output buffer is duly reserved before the prior reserved reproduction from the four output buffers is completed. If the formation of tone data to be written in the next output buffer is completed during a particular frame when the number of reserved output buffers is "4", reproduction reservation of the output buffer is made only after completion of the reproduction in the frame so that the number of reserved output buffers does not exceed "4".

The output buffers that should be provided in the RAM 5 to carry out Measure 3 include those for effecting the reproduction reservation prior to the activation of the tone generator section, one for writing there into tone data completely formed by the tone generator section, and one or more spare output buffers to be used in case the quantity of the tone data actually formed by the tone generator section exceeds the predetermined number of tone data to be written in one output buffer. The total number of the output buffers is "6" in the example of FIG. 7. However, the spare output buffers may be omitted if the tone data formation is compulsorily stopped when the quantity of the actually formed tone exceeds the predetermined number of tone data to be written in one output buffer. Thus, five output buffers will be sufficient in the example of FIG. 7.

Measure 4

In case no output buffer is reserved in the output device within a predetermined time period, tone data forming operations that should have been completed by that time is compulsorily discontinued, and new arithmetic forming operations are caused to begin with tone data originally scheduled for that time. According to this measure, even when the reproduction reservation can not be made in time and thus a temporary disorder is caused in generated tone, stable tone formation can be promptly restored so that accompanying noise is minimized.

In the example of Measure 3 of FIG. 7, reproduction reservation of the output buffer having stored therein tone data formed by the tone generator is shown as being made by the time when reproduction has been completed for every output buffer previously reserved in the output device. However, in case the activation of the tone generator section is greatly delayed by an influence of the other processing, it is possible that the reproduction reservation of the output buffer having stored therein tone data formed by the tone generator is not timely made even in a frame where the reproduction from every previously reserved output buffer has been completed (i.e., the number of reserved output buffers is decreased to "0"). In such a case, by effecting Measure 3 and Measure 4 in combination, arithmetic forming operations of tone data that should have been completed before the number of reserved output buffers becomes "0" is discontinued compulsorily, another output buffer reservation is made in the output device, and then new arithmetic forming operations are caused to begin with tone data originally scheduled for that time.

A detailed description will now be made about an example of operation of the computer music system which is designed to effect the above-mentioned measures, with reference to FIGS. 8 to 25.

Figure 8:
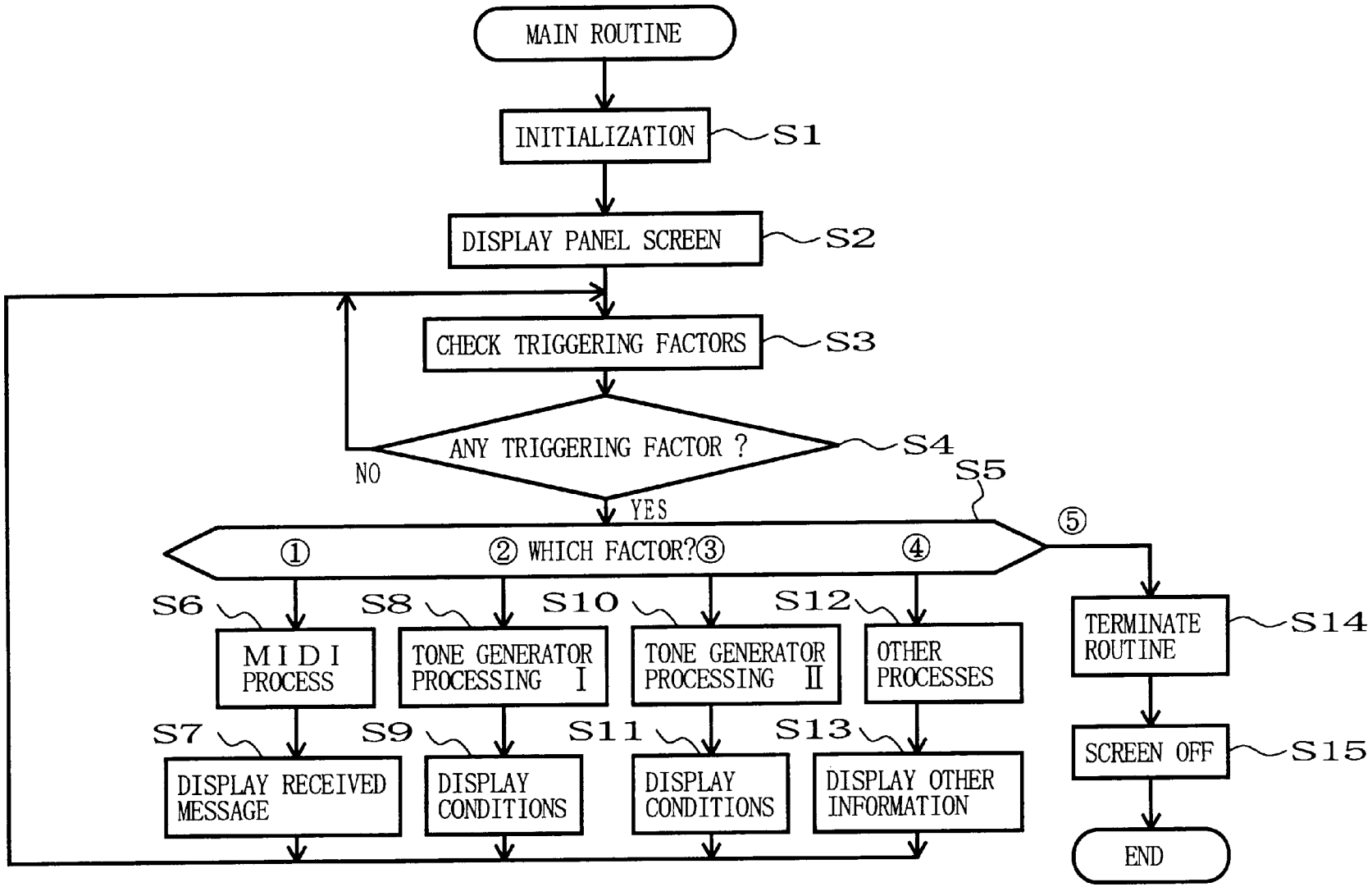
FIG. 8 is a flowchart of a main routine executed by a CPU of FIG. 1.

FIG. 8 is a flowchart of a main routine executed by the CPU 3 of FIG. 1. First, an initialization process is executed at step S1, which clears data stored in the tone generator registers for all the tone generating channels (including the primary and secondary tone generator registers as mentioned earlier in connection with Measure 2), as well as data stored in the working area of the RAM 5 (including the output buffers as mentioned earlier in connection with Measure 4) as shown at step S21 of FIG. 9. Then, waveform data recorded on the hard disk device 10 are loaded into the RAM 5 at step S22 of FIG. 9. Following this, the output device is initialized at step S23, and reproduction from the cleared output buffers (here, "four" output buffers as in the example of FIG. 7) is reserved, at step S24, in the output device prior to the activation of the tone generator section as mentioned earlier in connection with Measure 3. Then, at step S25, the output device is activated by the D/A converter 12 generating and passing a reproduction sampling clock pulse to the DMA controller 11, and a software timer is activated to generate an internal interrupt signal for activating the tone generator section. For example, the software timer is caused to generate an internal interrupt signal by the CPU 3 referring to a hardware timer.

As earlier mentioned in connection with Measure 1, the software timer is capable of generating internal interrupt signals at a plurality of timing or activating time in each of the frames (it is assumed here that internal interrupt signals can be generated ten times in each frame having a length of 100 milliseconds, i.e., at intervals of 10 milliseconds). As set forth previously, the internal interrupt signal is not necessarily generated by the software timer at each activating time (i.e., every 10 milliseconds); namely, when the CPU 3 is engaged in processing by the operating system or other software processing, the internal interrupt signal can not be generated even when the activating time arrives. So, according to the embodiment, a timer flag is set whenever the timer 2 counts out passage of a predetermined time length corresponding to one activating time (e.g., 10 milliseconds), the current state of the timer flag is checked once the CPU 3 becomes available for the processing of the software tone generator, so that the interrupt signal is generated in accordance with a current condition of the flag. Thus, one internal interrupt signal is generated whenever the CPU 3 is determined as available for the processing of the software tone generator during the predetermined time length corresponding to one activating time (e.g., 10 milliseconds). However, whenever the CPU 3 is determined as not available for the processing of the software tone generator during the predetermined time length, the CPU 3 does not check the timer flag and hence the predetermined time elapses with no internal interrupt signal generated and then a next flag will be set; that is, no internal interrupt signal is generated in response to the preceding flag.

In this way, the internal interrupt signal is not necessarily generated at each activating time, as illustrated in FIGS. 5 and 6. Further, as may be understood from the foregoing, the intervals of the internal interrupt signals generated consecutively at several activating times are not always accurately fixed at the predetermined time length (e.g., 10 milliseconds) but may slightly vary to be slightly shorter or longer than 10 milliseconds. Because, the exact generation timing of the internal interrupt signal depends on the processing condition of the CPU 3 (i.e., on when the CPU 3 checks the timer flag).

Referring back to FIG. 8, after the initialization process, there is presented, on the display 9, a panel screen (not shown) for indicating various information corresponding to the progression of the processing and for being used by an user or human operator to enter various control data with the mouse 7, at step S2. Because reproduction from several output buffers are reserved in the output buffer by the initialization (FIG. 9) prior to the activation of the tone generator section, the output device first executes the reproduction of the previously-reserved four output buffers and then of output buffers subsequently reserved by the tone generator section. Thus, the tone reproduction responsive to supplied MIDI messages will be delayed by a total time length of the frames corresponding to the number of the previously-reserved output buffers (four frames in the example of FIG. 7). Where information based on a supplied MIDI message is presented on the panel screen of the display 9, it is desirable to defer the display timing by the total time length of the frames corresponding to the number of the previously-reserved output buffers.

At step S3 following step S2, the main routine checks occurrence of the following triggering factors:

- Triggering factor 1: Supply of a MIDI message from the sequencer program (see FIG. 2);
- Triggering factor 2: Generation, by the software timer, of an internal interrupt signal activating the tone generator section;
- Triggering factor 3: Detection of a processing request from the output device;
- Triggering factor 4: Detection of another request such as an input event on the panel screen of the display 9 or a command input event on the keyboard 8 (excluding a main routine ending command); and
- Triggering factor 5: Detection of an input event of a main routine ending command on the keyboard 8.

After step S3, a determination is made at step S4 as to whether or not any one of the above-mentioned triggering factors has occurred. If answered in the negative at step S4, the main routine reverts to step S3 in order to repeat the operations of steps S3 and S4 until any one of the above-mentioned triggering factors occurs. Once any one of the triggering factors has occurred, an affirmative determination results at step S4 and the main routine moves on to step S5, where a further determination is made as to which of the triggering factors has occurred.

If triggering factor 1 (i.e., supply of a MIDI message from the sequencer program) has occurred, predetermined MIDI process is executed at step S6 and a predetermined visual display of the received message, such as data indicating for which of MIDI channels the MIDI message has been supplied, is visually presented at step S7 on the panel screen. After this, the main routine loops back to step S3 in order to repeat the operations at and after step S3.

Figure 10:
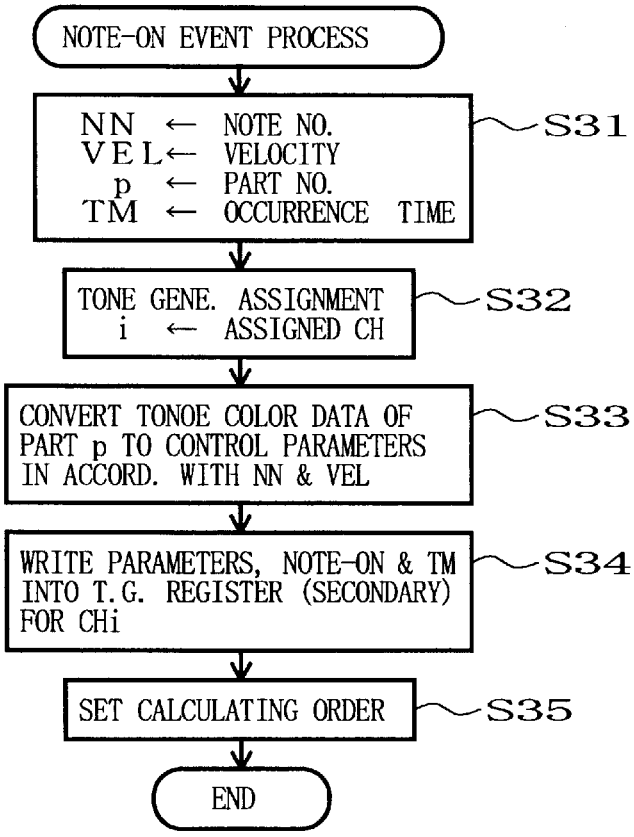
FIG. 10 is a flowchart illustrating an example of a note-on event process executed by the CPU.

The MIDI process at step S6 includes note-on event and note-off event processes based on note-on and note-off event data. FIG. 10 is a flowchart illustrating an example of the note-on event process. At first step S31, data indicative of the note number and velocity of the note-on event, part number of a performance part associated with the note-on MIDI channel and occurrence time of the note-on event are stored into respective registers NN, VEL, p and TM. At next step S32, one of the tone generating channels is assigned to tone generation based on the note-on event, and the number of the assigned channel is stored into register i. Then, at step S33, voice data of the tone color selected for the part number stored in register p is read out from the RAM 5 and then converted into control parameters (including a pitch-designating frequency number FN) for controlling the tone generator section in accordance with the note number and velocity stored in the registers NN, VEL (FIG. 2).

Then, at step S34, the control parameters are stored, along with the note-on event data and event occurrence time in register TM, into the tone generator register for the tone generating channel of the channel number indicated by register i, so as to reserve note-on operations for timing corresponding to the occurrence time.

The reasons for loading the event occurrence time from register TM into the tone generator register are as follows. As previously mentioned, there is a time difference, of about four frames, between the note-on event occurrence time and the time when the tone reproduction is actually initiated on the basis of the note-on event; that is, the start of the tone reproduction is delayed by the time corresponding to about four frames. It is sufficient that the tone generating processing (corresponding to later-described "tone generator processing I") generate corresponding tone data at any optional timing within a range of the time difference; that is, a processing time delay within that range is tolerated. Thus, without knowing the note-on event occurrence time, the tone generating processing executed at any optional timing different from the occurrence time will be unable to generate the corresponding tone data.

In case the tone generating channel in question is in use, step S34 stores the control parameters into the secondary tone generator register rather than the primary tone generator register. In this way, new tone generating processing can be immediately prepared in the secondary tone generator register while securing continued execution of current tone generating processing in the tone generating channel using the primary tone generator register. In the event that the control parameters are stored into the secondary tone generator register, a reservation is made, in a predetermined reservation area of the primary tone generator register, for damping (rapid attenuation of a tone volume envelope) at such timing corresponding to the occurrence time stored in register TM.

At step S35 following step S34, a calculating order across all the tone generating channels assigned to the tone generation is set such that the tone generating calculation is effected from the channel assigned to generate a tone of the last note-on occurrence time to the channel assigned to generate a tone of the earliest note-on occurrence time, i.e., that the channel assigned to generate a tone of the last note-on occurrence time has priority over the other channels in the tone generating calculation. After step S35, the CPU 3 returns to the main routine.

Figure 11:
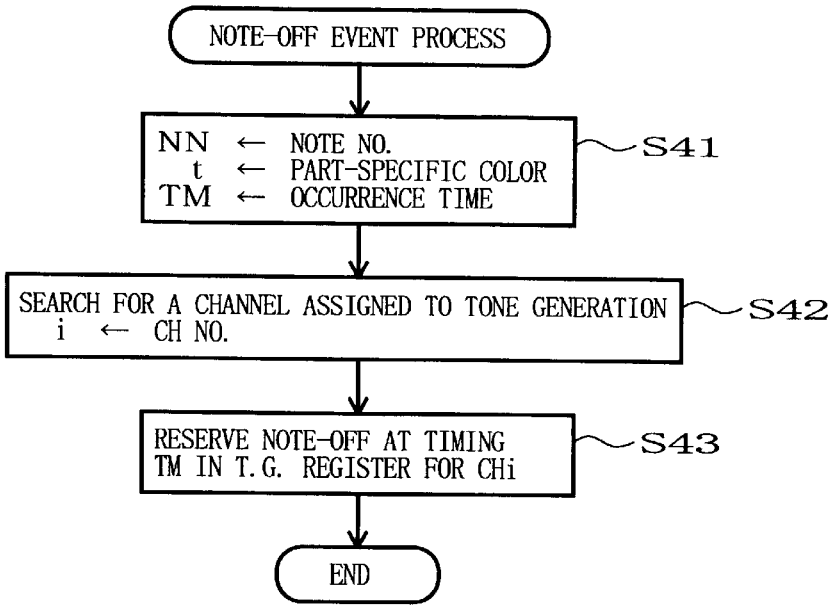
FIG. 11 is a flowchart illustrating an example of a note-off event process executed by the CPU.

FIG. 11 is a flowchart illustrating an example of the note-off event process. At first step S41, data indicative of the note number of the note-off event, tone color selected for the performance part associated with the note-off MIDI channel and occurrence time of the note-off event are stored into respective registers NN, t and TM. Then, at step S42, a search is made for one of the tone generating channels assigned to generate a tone with the color stored in register t, and its channel number (CH NO.) is stored into register i. After this, in a predetermined reservation area of one of the primary and secondary tone generator (T.G.) registers for the tone generating channel of the number stored in register i (CHi), a reservation is made for note-off operations at timing corresponding to the occurrence time stored in register TM at step S43.

Referring back to step S5 of FIG. 8, if triggering factor 2 (i.e., generation, by the software timer, of an internal interrupt signal activating the tone generator section) has occurred, the CPU 3 executes "tone generator processing I" at step S8 and goes to step S9 in order to visually present predetermined conditions, such as the computing capability of the CPU 3 and volume level of each generated tone, on the panel screen of the display. Then, the CPU 3 loops back to step S3 to repeat the operations at and after step 3.

Figure 12:
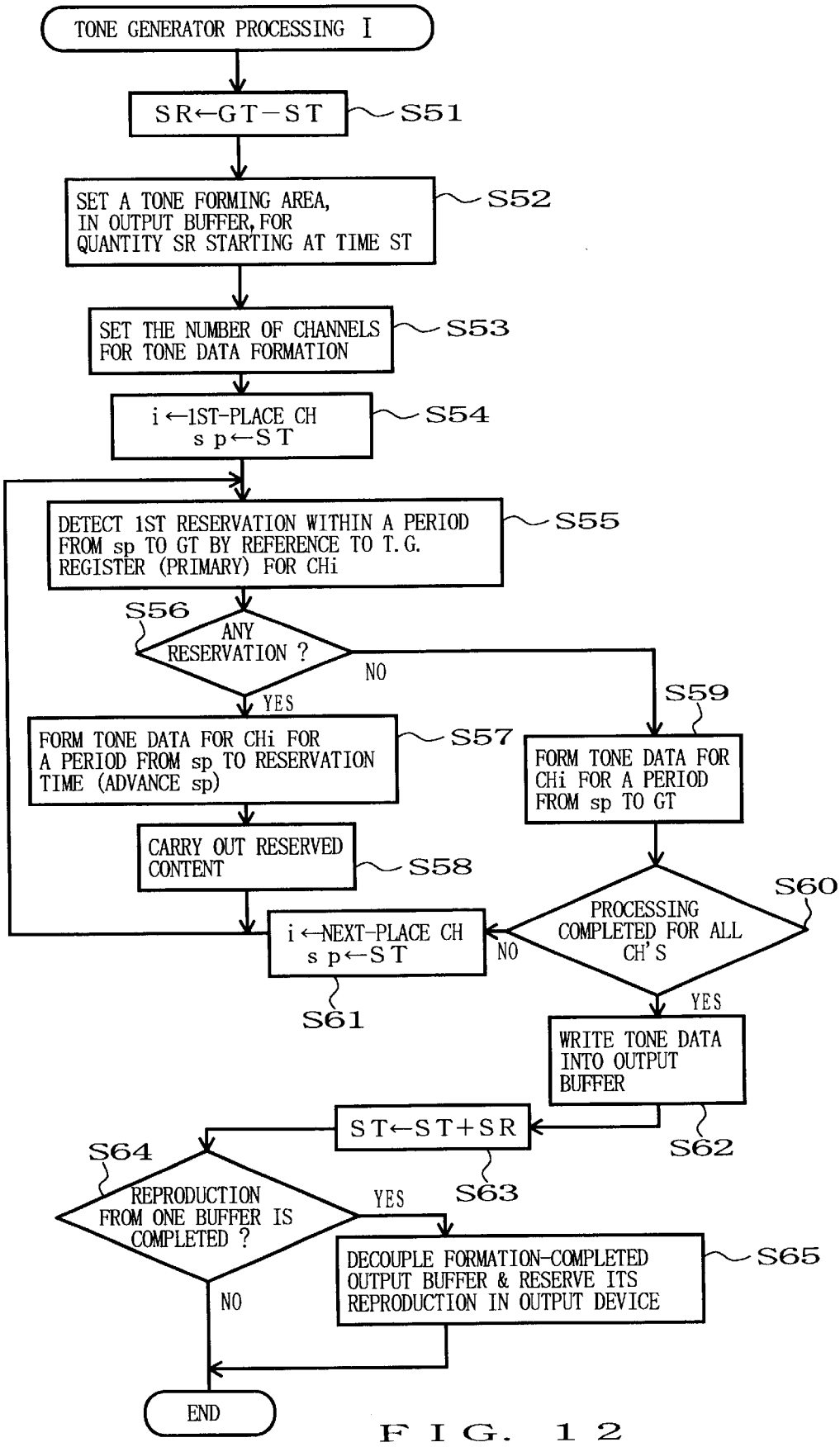
FIG. 12 is a flowchart illustrating an example of tone generator processing I executed by the CPU.

Tone generator processing I forms part of the tone generator section. As shown in FIG. 12, at first step S51, the CPU 3 subtracts, from a current time GT, an input time ST of one of MIDI messages for which the tone generation has been completed last and then sets the value of the subtraction result as a quantity-to-be-formed SR (this quantity SR indicates a quantity of tone data to be formed and is expressed in a time length corresponding to a target number of tone data to be formed by the current activation of the tone generator section).

More specifically, at step S51, all tone data that failed to be formed by the tone generator section due to a failure of the internal interrupt signal generation (i.e., all left-unformed tone data) are belatedly formed in response to a next internal interrupt signal, as in the example of Measure 1 shown in FIG. 5. Thus, even when the internal interrupt signal is not generated at some of the predetermined activating times in one frame, the predetermined number of tone data to be written in one output buffer can be formed within the same frame, which thereby avoids an unwanted hindrance to the tone generation. In the example of FIG. 5, the quantity-to-be-formed SR is 10 milliseconds at the first activating time, but is 20 milliseconds at the third activating time because no internal interrupt signal is generated at the second activating time. Alternatively, as previously noted in connection with Measure 1, tone data that failed to be formed by the tone generator section due to a failure of the internal interrupt signal generation (leftunformed tone data) may be formed in a distributed fashion at a plurality of subsequent activating times when the internal interrupt signals is actually generated as in the example of FIG. 6, or may be formed progressively by the end of the last activating time in the frame.

Figure 9:
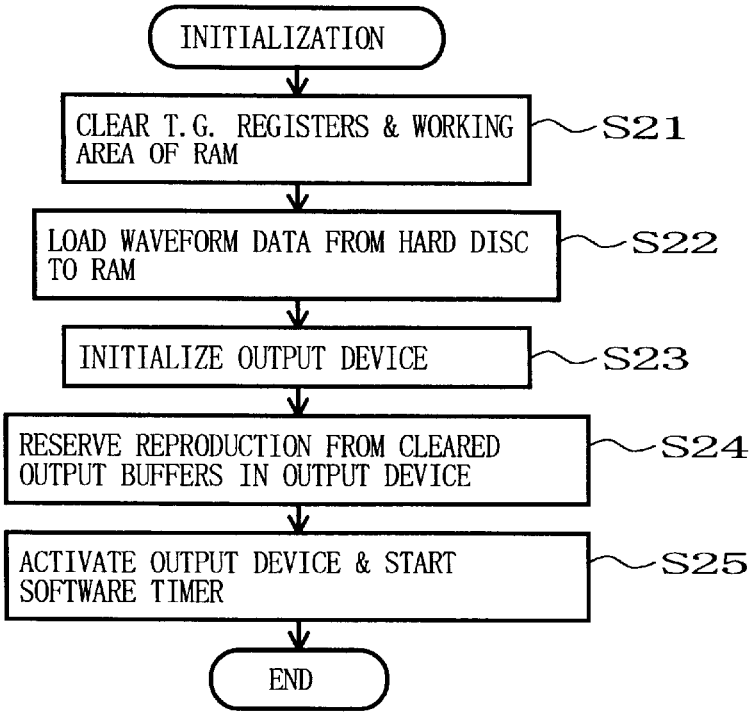
FIG. 9 is a flowchart of an initialization process executed by the CPU.

At step S52 following step S51, a tone forming area for the quantity-to-be-formed SR starting at time ST is set in one of the output buffers other than those reserved in the initialization process of FIG. 9. Next step S53 sets a specific number of the tone generating channels to be used for forming tone data in the following manner. First, on the basis of a calculating time period required for arithmetically forming the quantity SR of tone data in one tone generating channel, and a currently available calculating time period EJ (i.e., a time period from a calculation starting time KJ when a current internal interrupt signal has been actually generated up to a calculation ending time SJ when a next internal interrupt signal is expected to be generated), the CPU 3 ascertaines how many of the tone generating channels are available for forming the quantity SR of tone data within the time period EJ. If the number of the available tone generating channels ascertained by the CPU 3 is equivalent to or greater than the number of the tone generating channels assigned to the tone generation in the note-on event process of FIG. 10, then the number of the assigned channels is set as the number of the tone generating channels to be used for forming tone data. If, on the other hand, the number of the available tone generating channels ascertained by the CPU 3 is smaller than the number of the assigned tone generating channels, then the number of the available channels is set as the number of the tone generating channels to be used for forming tone data; namely, as previously noted in connection with Measure 1, the number of the tone generating channels to be used for forming tone data is reduced to secure formation, in one frame, of the predetermined number of tone data to be written in one output buffer.

At next step S54, the channel number of the tone generating channel given the first place in the calculating order set at step S35 of the note-on event process is stored into register i, and start pointer sp is caused to point to the last input time ST. Following this, a first reservation (such as reservation for pitch bend, note-off or damping) within a period from the start pointer sp to the current time GT is detected at step S55 by reference to the reservation area in the primary tone generator register for the tone generating channel designated by register i. Then, a determination is further made at step S56 as to whether or not any reservation has been found.

If answered in the affirmative at step S56, the start pointer sp is advanced to point to the time of the detected reservation at step S57. As set forth above, the tone generating processing reads out waveform data from the RAM 5 at a rate according to the control parameters stored in the tone generator register. The read-out waveform data is then subjected to tone color control (filter operation), volume control (multiplication by tone volume envelope data), modulation control of pitch, color, volume, and effect impartment in accordance with the control parameters, so as to create tone data.

At next step S58, the content of the detected reservation is stored into the tone generator register so as to carry out the reserved content. For example, if the detected reservation is for note-off operations, the note-off event data is stored into the primary tone generator register so as to start a release of the tone volume envelope. If the detected reservation is for damping, the tone generator register to be used for the tone generating channel is changed from the primary to the secondary as noted earlier in connection with Measure 2 after completion of the damping, i.e, after the tone volume envelope level has decreased below a predetermined level. Conversely, the damping may be performed on the primary tone generator register after the tone generator register to be used for the tone generating channel is changed from the primary to the secondary. As explained earlier in connection with step S34 of FIG. 10, in the case where the control parameters, note-on event data and note-on event occurrence time are stored into the secondary tone generator register, a reservation is made, in the reservation area of the primary tone generator register, for damping at particular timing corresponding to the occurrence time stored in register TM. Accordingly, once the timing corresponding to the occurrence time stored in register TM arrives, the tone generating processing using the secondary tone generator register will be commenced after executing of the damping.

After step S58, the CPU 3 loops back to step S55 to repeat the operations at and after step S55.

If answered in the negative at step S56, i.e., no reservation has been detected, or once the determination has become negative due to the operations of steps S57 and S58, the tone generating processing is executed at step S59, for the channel designated by register i, for the period from the start pointer sp to the current time GT. In this manner, tone data are created in the tone forming area up to the quantity-to-be formed SR in the tone generating channel.

Then, at step S60, a determination is made as to whether the tone generating processing has been completed for all of the tone generating channels having been set at step S53. If answered in the negative at step S60, the channel number of the tone generating channel given the next place in the calculating order is stored into register i, and start pointer sp is set to point to the input time ST, at step S61. Then, the CPU 3 loops back to step S55 to repeat the operations at and after step S55. If answered in the affirmative at step S60, or once the determination has become affirmative due to execution of the operations at and after step S55, the CPU 3 terminates the tone generating processing and moves on to step S62. If the number of the available tone generating channels ascertained by the CPU 3 is smaller than the number of the assigned tone generating channels, the number of tone generating channels to be used for simultaneously sounding tones is reduced by omitting the tone generating processing for one or more tone generating channels given later places in the calculating order.

At step S62, the accumulated tone data of the assigned channels, with or without effects imparted thereto, are written into the tone forming area of the output buffer set at step S52. At next step S63, the start time ST added with the quantity-to-be-formed SR is set as a new start time ST. This new start time ST is used as a calculation starting point for next execution of "tone generator processing I". After this, a further determination is made at step S64 as to whether or not formation of the predetermined number of tone data to be written in one output buffer has been completed. If answered in the negative at step S64, the CPU 3 returns to the main routine. Once the determination becomes affirmative at step S64, the output buffer is decoupled from the other output buffers that is coupled thereto in "tone generator processing II" as will be later described, and its reproduction is reserved in the output device at step S65. After this, the CPU 3 returns to the main routine.

Referring back to step S5 of FIG. 8, if triggering factor 3 (i.e., detection of a processing request from the output device) has occurred, the CPU 3 executes "tone generator processing II" at step S10 and goes to step S11 in order to visually present predetermined conditions on the panel screen. Then, the CPU 3 loops back to step S3 to repeat the operations at and after step 3.

Tone generator processing II also forms part of the tone generator section and is executed in response to a request generated by activating the output device (i.e., an external interrupt process by the DMA controller 11).

Figure 13:
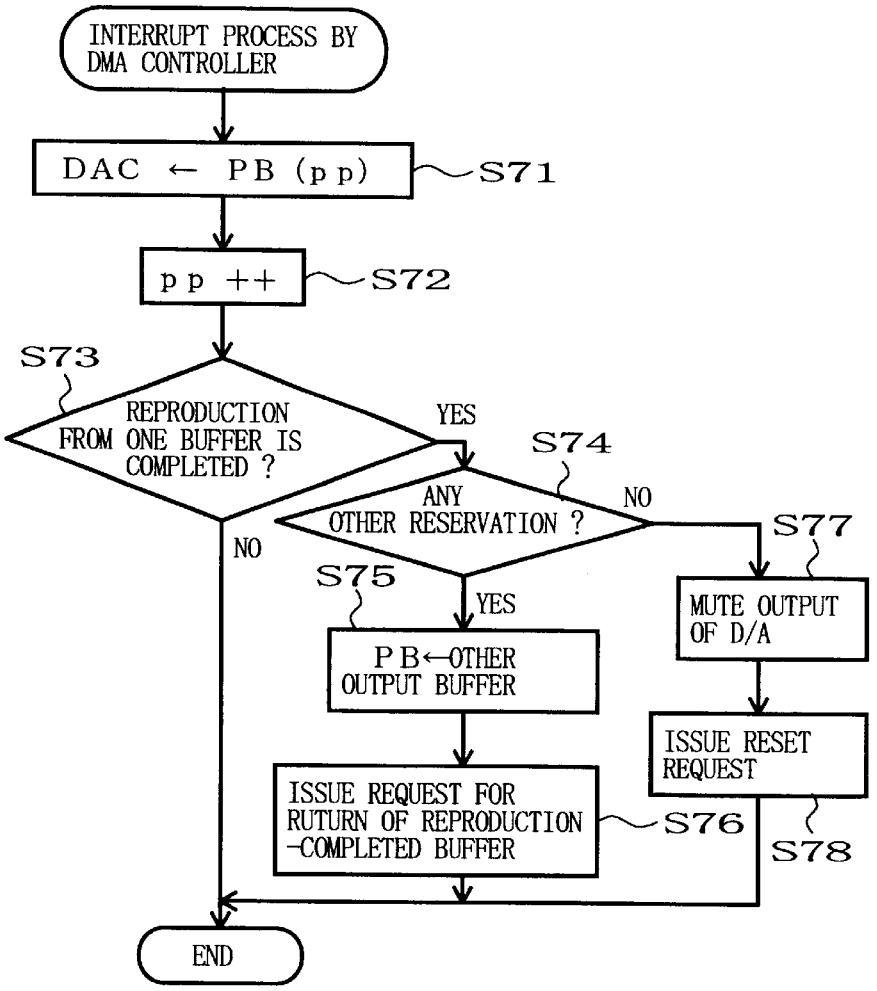
FIG. 13 is a flowchart illustrating an example of an external interrupt process carried out by a DMA controller of FIG. 1.

FIG. 13 is a flowchart of the external interrupt process carried out by the DMA controller 11 each time one sample of tone data is sent to the D/A converter 12, i.e., at a reproduction sampling frequency of the D/A converter 12. By virtue of this external interrupt process, tone data for one frame stored in the output buffer are read out, one sample per reproduction sampling cycle, from the output buffer and supplied to the D/A converter 12. First step S71 supplies the D/A converter 12 with one sample of tone data that is pointed to by pointer pp and read out from one of the reserved output buffers pointed to by buffer pointer PB. Then, the pointer pp is incremented by one at step S72, and it is determined at step S73 whether or not all the tone data in the output buffer have been supplied to the D/A converter 12, i.e., whether the necessary reproduction process has been completed for the output buffer. If the reproduction process has not been completed for the output buffer, the CPU returns to the main routine.

If, on the other hand, the reproduction process has been completed for the output buffer as determined at step S73, a further determination is made at step S74 as to whether any other output buffer is currently reserved for reproduction. Even when no other output buffer having written therein tone data formed by the tone generator is reserved because the activation of the tone generator section is delayed by an influence of other processing, an affirmative determination results at step S74 until the reproduction from all the already-reserved output buffers (those reserved in the initialization of FIG. 9 or in "tone generator processing I") is completed. With such an affirmative determination at step S74, the DMA controller 11 moves on to step S75 in order to set the buffer pointer PB to point to the other output buffer. As explained earlier in connection with Measure 3, this arrangement can expand such a tolerable range of time delay in activating the tone generating processing which can avoid an unwanted break in a stream of generated tones. At step S76 following step S75, a request is issued for returning to "tone generator processing II" the output buffer for which the reproduction of the tone data has been completed (reproduction-completed output buffer). Then, the process returns to the main routine.

If the activation of the tone generator section is greatly delayed, there may arise a situation where no output buffer having written therein tone data formed by the tone generator is reserved even in a particular frame where the reproduction from all the reserved output buffers has been completed. In such a case, a negative determination results at step S74, so that the DMA controller 11 branches to step S77 to mute output signals of the D/A converter 12 so as to prevent noise sound. At next step S78, a reset request is issued to "tone generator processing II" for resetting the tone generation. Then, the process returns.

Figure 14:
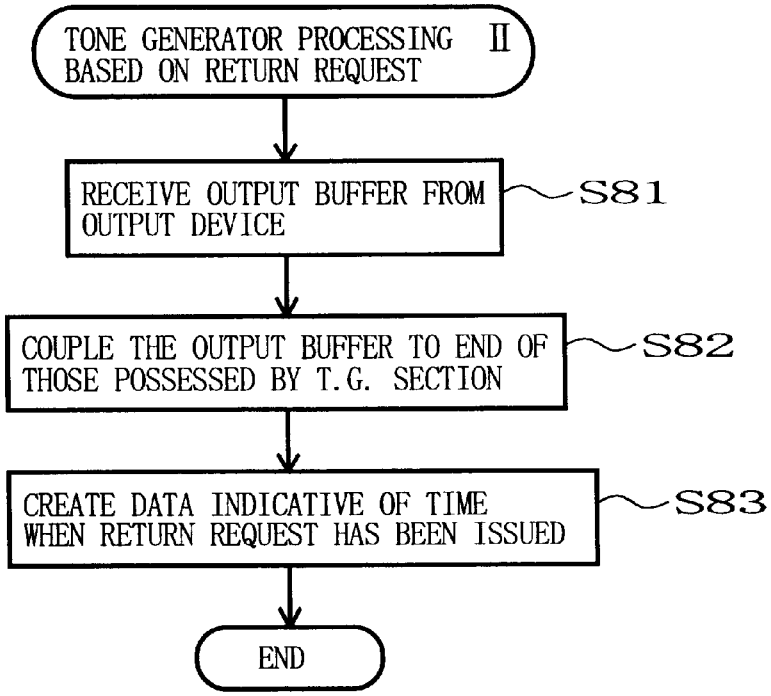
FIG. 14 is a flowchart of an example of tone generator processing II executed by the CPU on the basis of a return request issued from the DMA controller.

FIG. 14 is a flowchart of an example of "tone generator processing II" executed by the CPU 3 on the basis of the return request issued from the output device (step S76 of FIG. 13). The CPU 3 receives the output buffer returned from the output device at step S81, and then at step S82, it couples the returned output buffer to the end of the other output buffers already possessed by the tone generator section after clearing the returned output buffer. This coupling results in virtually linking together the output buffers in a series so as to treat them as a single larger buffer. This eliminates a need to provide these output buffers in physically neighboring areas of the RAM 5. At next step S83, data indicative of the time when the return request has been issued is created, so as to adjust the operation of the tone generator section by ascertaining presence or absence of a difference in operational timing between the tone generator and the output device. After step S83, the CPU 3 returns to the main routine.

Figure 15:
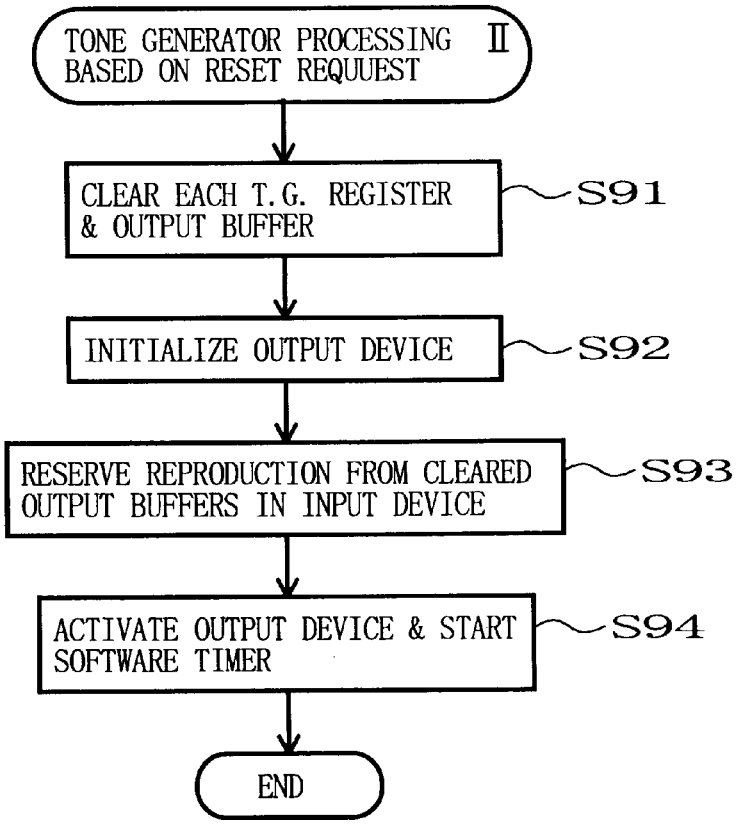
FIG. 15 is a flowchart of an example of tone generator processing II executed by the CPU on the basis of a reset request issued from the DMA controller.

FIG. 15 is a flowchart of an example of "tone generator processing II" executed by the CPU 3 on the basis of the reset request issued from the output device (step S78 of FIG. 13). First, at step S91, the CPU 3 clears all the data from the tone generator register for each of the tone generating channels and from the output buffers in the RAM 5. Then, similarly to steps S23 to S25 of the initialization process of FIG. 9, the output device is initialized at step S92, the four output buffers cleared at step S91 are again reserved for reproduction at step S93, and the output device is activated and the software timer is started at step S94. Then, the CPU 3 returns to the main routine.

In "tone generator processing II" based on the reset request, when no output buffer is reserved in the output device, the tone generation having been executed so far in the tone generator section is discontinued compulsorily and reproduction from the cleared output buffer is reserved again in the output device, as explained earlier in connection with Measure 4. Then, new tone generation is commenced by activating the tone generator section on the basis of another MIDI message supplied thereafter. Thus, even when the reproduction reservation is not made in time and a temporary disorder is caused in the tone generation, stable tone generating operation can be promptly restored and hence unwanted noise can be minimized.

Referring back to step S5 of FIG. 8, if it is determined triggering factor 4 has occurred, the CPU 3 executes a process responsive to the detected request, such as a process responsive to an input event on the panel screen of the display 9 or to a command input event on the keyboard 8, at step S12. Then, other information corresponding to the process is visually presented on the panel screen at step S13. After this, the CPU 3 loops back to step S3 to repeat the operations at and after step 3.

Finally, if triggering factor 5 (i.e., detection of a main routine ending command on the keyboard 8) has occurred, the CPU 3 executes a predetermined process to terminate the main routine at step S14, causes the panel screen to disappear from the display 9 at step S15 and then returns to the main routine.

In the event that two or more of the above-mentioned triggering factors have occurred as determined at step S5, the operations at and after step S5 are executed, for example, in ascending order of the factor numbers (i.e., from triggering factor 1 to triggering factor 5). Steps S3 to S5 virtually represents task management in pseudo multitask processing; however, in effect, while a certain process is being executed on the basis of occurrence of any of the triggering factors, the process may be discontinued, by occurrence of another triggering factor of higher priority, to execute another process. For example, while "tone generator processing I" is being executed in response to occurrence of triggering factor 2, the MIDI process may be executed by interruption due to occurrence of triggering factor 1.

The following paragraphs will describe various modifications of the above-described embodiment.

In the above-described embodiment, each time the software timer generates an internal interrupt signal, the CPU 3 subtracts, from a current time GT, an input time ST of one of MIDI messages for which tone generation has been completed last and sets the value of the subtraction result as a quantity-to-be-formed SR. Namely, the above-described embodiment is based on the scheme where all tone data that failed to be formed by the tone generator section due to a failure of internal interrupt signal generation are formed in response to generation of a next internal interrupt signal. Such a scheme is advantageous in that it can put the pending formation of all these left-unformed tone data into effect at the soonest possible time, but disadvantageous in that the quantity SR of tone data to be formed in response to a next internal interrupt signal will become too great in case the interrupt signal fails to be generated at many consecutive activating times. The greater quantity-to-be-formed SR will make it necessary f or the CPU 3 to spend a longer time in executing "tone generator processing I". As a result, the CPU 3 will be exclusively used, successively for a long time, in executing "tone generator processing I", and thus there may arise an undesirable situation where when there occurs, during the execution of "tone generator processing I", one or more triggering factors of "tone generator processing II" or the like having lower priority, the CPU 3 can not readily proceed to execution of such lower-priority processing. Further, the greater quantity-to-be-formed SR will unavoidably result in a significant decrease in the number of tone generating channels capable of simultaneously forming tone data when the available calculating time period EJ is running short.

In view of the foregoing inconveniences, various modifications of the present invention will be described where the pending tone data formation is effected in a progressive manner.

Modification 1

According to this modification, each time an internal interrupt signal is generated by the software timer, a "cue" process, rather than "tone generator processing I" mentioned above, is executed. In the cue process, signals each informing that an internal interrupt signal has been generated (and hence a tone waveform should now be created) are generated in quantities corresponding to an elapsed time from the internal interrupt signal generation, and then the generated signals are written into a cue buffer provided in the RAM 5. Each of these signals will hereinafter be called a "waveform creation cue". When one or more waveform creation cues are written in the cue buffer, "modified tone generator processing I" is executed, where a quantity of tone data to be formed is set to be within such a predetermined limit that prevents the tone generating processing from taking too much time, and then tone data are formed up to that quantity, after which a specific number of the waveform creation cues corresponding to the formed quantity are cleared or erased one by one from the cue buffer. By executing "modified tone generator processing I" in response to detection of one or more waveform creation cues written in the cue buffer, the pending tone data formation is allowed to be effected in a progressive manner. In the case where the interrupt signal fails to be generated at several consecutive activating times within one frame, the number of the waveform creation cues written in the cue buffer increases, but this modification can effectively limit the quantity of formed tone data to within the predetermined range to thereby prevent the CPU 3 from being exclusively used, successively for a long time, in "modified tone generator processing I". As a result, the CPU 3 can more readily assure execution of lower-priority processing and avoid a significant decrease in the number of tone generating channels capable of simultaneously forming tone data.

Modification 1 will now be described in greater detail with reference to FIGS. 16 to 20.

Figure 16:
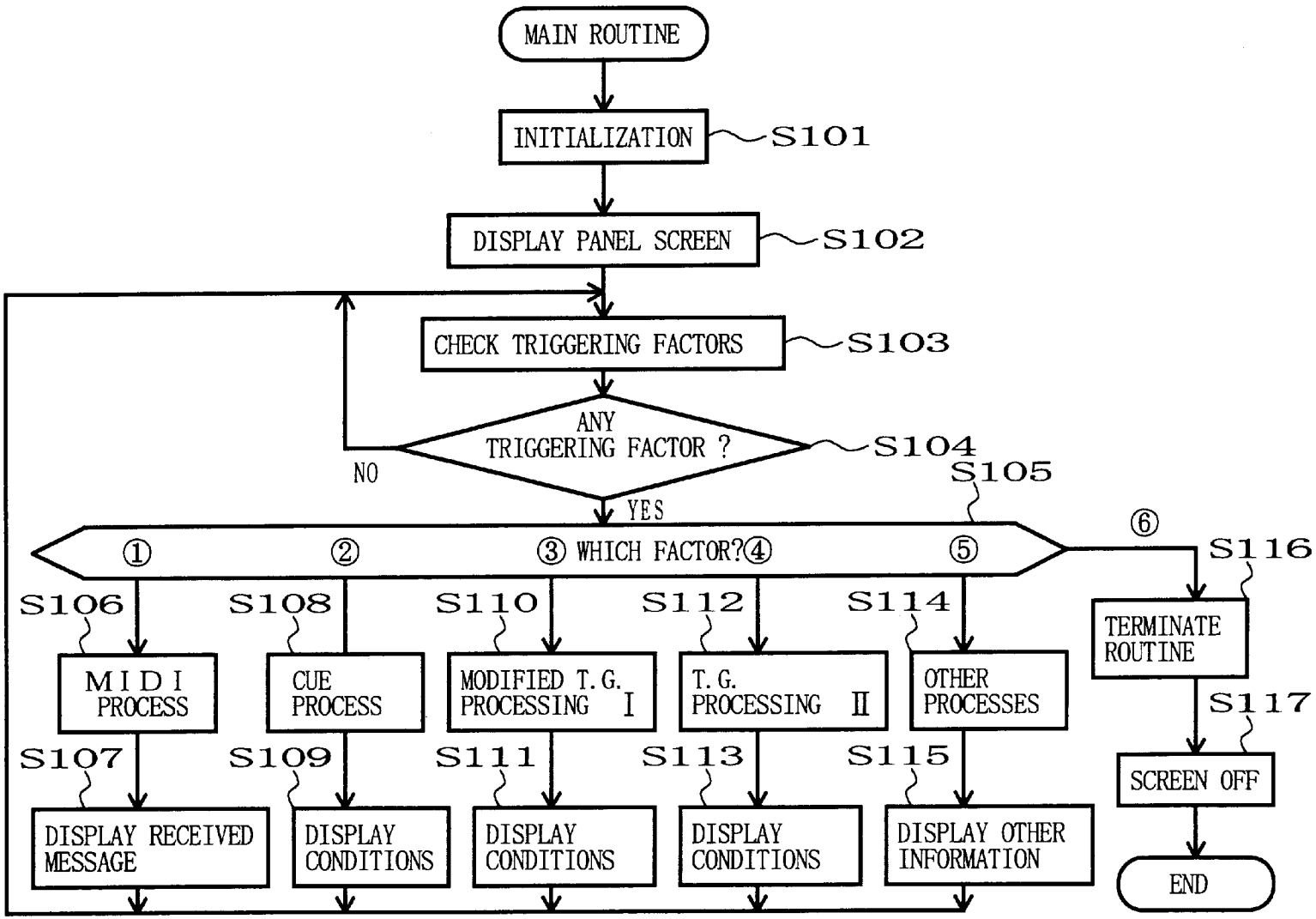
FIG. 16 is a flowchart of a main routine executed by the CPU in a modification of the present invention.

FIG. 16 is a flowchart of a main routine executed in the modification by the CPU 3. In an initialization process of S101, the CPU 3 executes the same operations as in the initialization process of step S1 of FIGS. 8 and 9 and also clears all data from the cue buffer of the RAM 5. At next step S102, the same operations as at step S2 of FIG. 8 are executed by the CPU 3.

At step S103 following step S102, the main routine checks occurrence of the following triggering factors:

- Triggering factor 1: Supply of a MIDI message from the sequencer program (see FIG. 2);
- Triggering factor 2: Generation, by the software timer, of an internal interrupt signal activating the tone generator section;
- Triggering factor 3: Detection a waveform creation cue written in the cue buffer;
- Triggering factor 4: Detection of a processing request from the output device;
- Triggering factor 5: Detection of another request such as an input event on the panel screen of the display 9 or a command input event on the keyboard 8 (excluding a main routine ending command); and
- Triggering factor 6: Detection of in input event of a main routine ending command on the keyboard 8.

The above-listed triggering factors are generally the same as those checked at step S3 of FIG. 8, except that the numbering of each of triggering factors 3 to 5 is moved down here by "one" due to addition of the detection of a waveform creation cue as triggering factor 3.

After step S103, a determination is made at step S104 as to whether or not any one of the above-mentioned triggering factors has occurred, similarly to step S4 of FIG. 8. When any one of the triggering factors has occurred, an affirmative determination results at step S104 and the CPU 3 moves on to step S105, where a further determination is made as to which of the six triggering factors has occurred. In the event that two or more of the above-mentioned triggering factors have occurred as determined at step S105, operations at and after step S5 are executed, for example, in ascending order of the factor numbers (i.e., in order from triggering factor 1 to triggering factor 6).

If triggering factor 1 has occurred as determined at step S105, the CPU 3 goes to steps S106 and S107, where the same MIDI process and received message display process as at steps S6 and S7 of FIG. 8 are executed.

If triggering factor 2 has occurred as determined at step S105, the CPU 3 goes to a cue process of step S108. Note that the delay or failure of the internal interrupt signal may of course be encountered in this modification as well, and thus the time interval between actually generated internal interrupt signals tends to exceed 10 milliseconds rather than being always fixed at 10 milliseconds.

Figure 17:
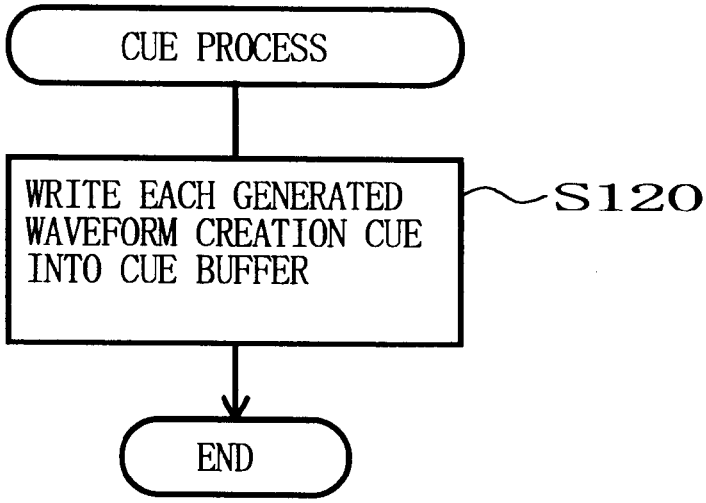
FIG. 17 is a flowchart of a cue process executed by the CPU.

In the cue process as shown in FIG. 17, it is ascertained what multiple of 10 milliseconds the time interval between last and current actually-generated internal interrupt signals is, and then waveform cue is generated in such quantities corresponding to a value of the ascertained multiple. For example, one waveform cue is generated if the time interval between last and current actually-generated internal interrupt signals is equivalent to or greater than 10 milliseconds but smaller than 20 milliseconds, and two waveform cues are generated if the time interval is equivalent to or greater than 20 milliseconds but smaller than 30 milliseconds. Each of the generated waveform creation cues is written into the cue buffer at step S120, and then the CPU 3 returns to the main routine. After completion of the cue process, the CPU 3 goes to step S109 in order to display predetermined conditions on the panel screen and then loops back to step S103.

If the cue process has written a waveform creation cue into the cue buffer, this means that triggering factor 3 has occurred. In response to the detection, at step S105, of such triggering factor 3, the CPU 3 proceeds to "modified tone generator processing I" of step S110.

Figure 18:
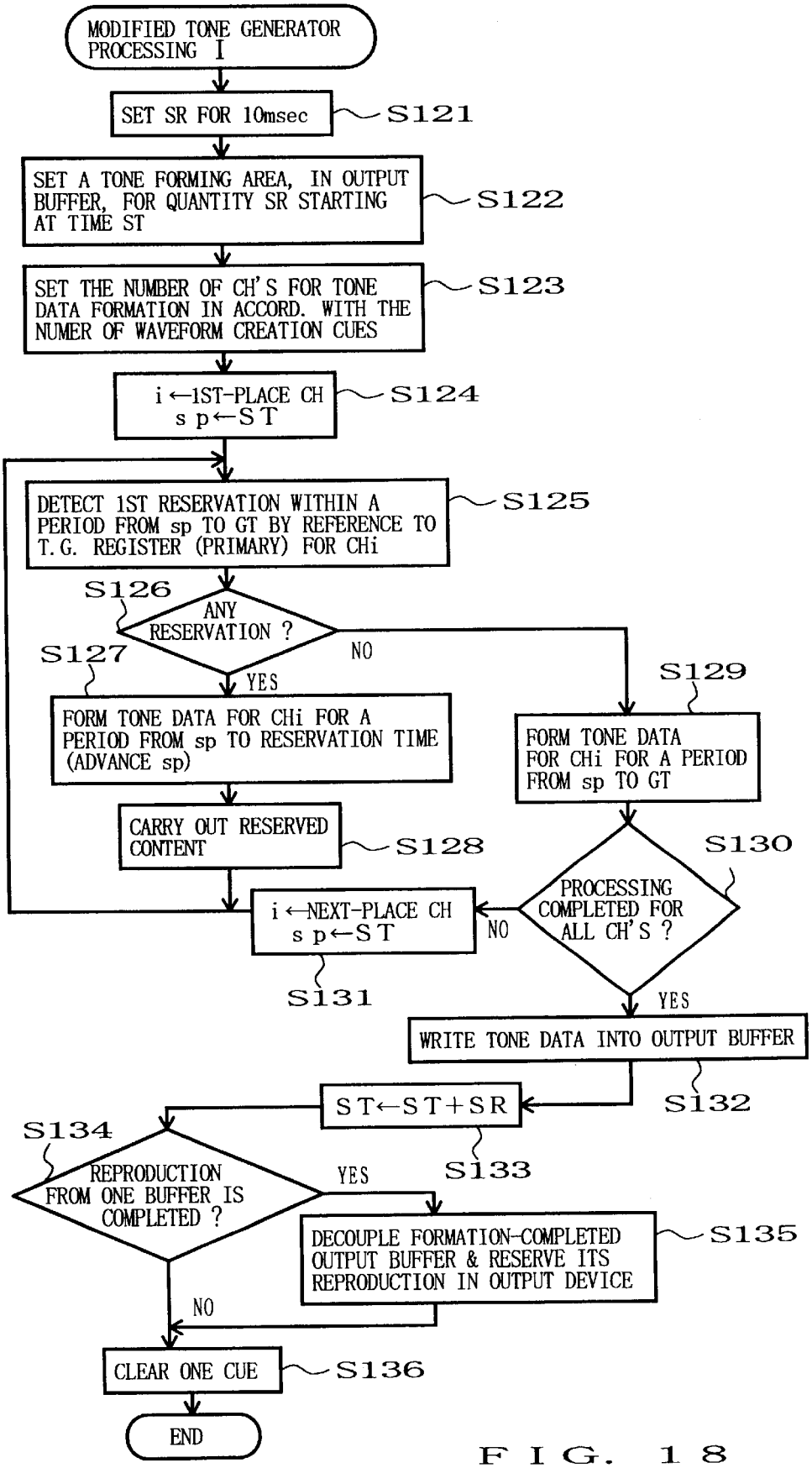
FIG. 18 is a flowchart illustrating an example of modified tone generating processing I.

FIG. 18 is a flowchart illustrating an example of "modified tone generating processing I". First , at step S121, the quantity-to-be-formed SR is set to 10 milliseconds which corresponds to one tenth of the predetermined number of tone data to be written in one output buffer.

At next step S122, a tone forming area for the quantity-to-be-formed SR starting at time ST (input time of one of MIDI messages for which tone generation has been completed last) is set in one of the output buffers other than those reserved in the initialization process, as at step S52 of FIG. 12.

Then, at step S123, the number of tone generating channels to be used for forming the quantity SR of tone data is set depending on the number of the waveform creation cues written in the cue buffer. More specifically, if the number of the waveform creation cues written in the cue buffer is smaller than a predetermined value (i.e., if the number of times when the internal interrupt signal successively failed to be generated is below the predetermined value), then the number of the channels assigned in the note-on event process of FIG. 10 is set as the number of the tone generating channels to be used for forming tone data. If, on the other hand, the number of the waveform creation cues written in the cue buffer is not smaller than the predetermined value (i.e., if the number of times when the internal interrupt signal successively failed to be generated is not smaller than the predetermined value), then the number of the tone generating channels to be used for forming tone data is set to be smaller than the number of the channels assigned in the note-on event process.

The reason why the number of the tone generating channels to be used for forming tone data is set to be smaller than the number of the assigned channels here is to reduce the necessary time for one execution of "modified tone generator processing I" and thereby expedite the pending formation of tone data. Note that unlike step at S53 of FIG. 12, it is not necessary to uniformly reduce the number of the tone generating channels in relation to available calculating time period EJ. Because this modified tone generator processing is activated by writing of the waveform creation cue into the cue buffer rather than generation of the internal interrupt signal and there is no need here to consider the available calculating time period EJ, there won't arise a situation where the number of the tone generating channels is reduced to an excessive degree.

At following steps S124 to S135 are executed the same operations as at steps S54 to S65 of FIG. 12. The CPU 3 returns to the main routine after clearing only one waveform creation cue from the cue buffer.

As described, the quantity-to-be-formed SR in one execution of "modified tone generator processing I" is always fixed at 10 milliseconds (corresponding to one tenth of the predetermined number of tone data to be written in one output buffer) in the example of FIG. 18. Thus, it is possible to prevent the CPU 3 from being exclusively used, successively for a long time, in "modified tone generator processing I", with the result that the CPU 3 can more readily secure execution of lower-priority processing and avoid a significant decrease in the number of tone generating channels capable of simultaneously forming tone data.

Figure 19:
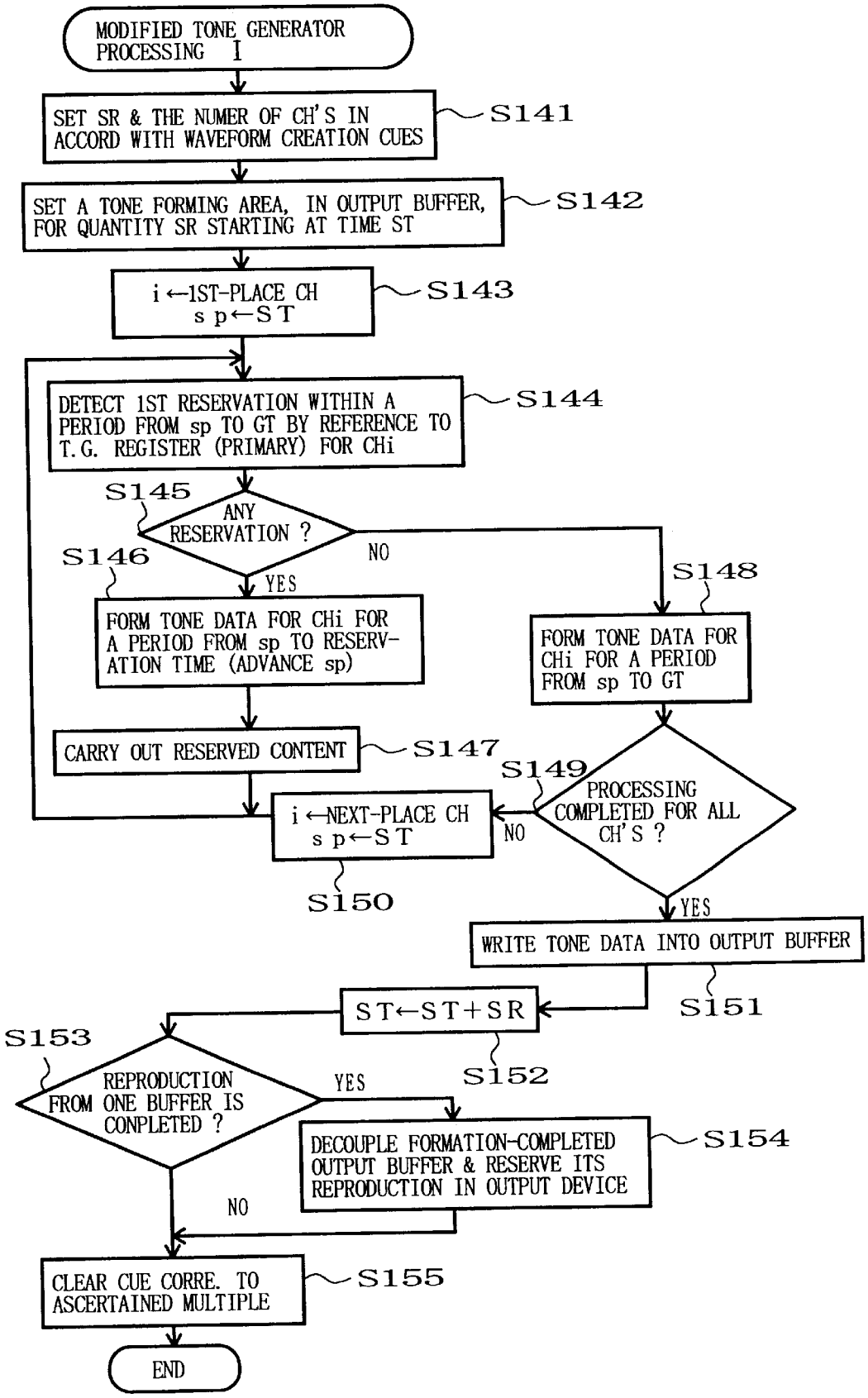
FIG. 19 is a flowchart illustrating another example of modified tone generating processing I.

FIG. 19 is a flowchart illustrating another example of "modified tone generating processing I". First, at step S141, the quantity-to-be-formed SR and the number of the tone generating channels to be used for forming tone data are set depending on the number of the waveform creation cues written in the cue buffer. The number of the tone generating channels to be used for forming tone data is set in a similar manner to step S123.

The following describes in more detail a manner in which the quantity-to-be-formed SR is set in this example. If the number of the waveform creation cues written in the cue buffer is smaller than a predetermined value (i.e., if the number of times when the internal interrupt signal successively failed to be generated is below the predetermined value), then the quantity-to-be-formed SR is set to 10 milliseconds. If, on the other hand, the number of the waveform creation cues written in the cue buffer is not smaller than the predetermined value (i.e., if the number of times when the internal interrupt signal successively failed to be generated is not smaller than the predetermined value), then the quantity-to-be-formed SR is set to 20 milliseconds that corresponds to two-tenth of the predetermined number of tone data to be written in one output buffer. For example, when generation of the internal interrupt signal has failed consecutively over 19 times to thereby cause the number of the waveform creation cues in the cue buffer to exceed 19, the quantity-to-be-formed SR may be set to 20 milliseconds now that the number of reserved output buffers has decreased from 4 to 2. Alternatively, when the number of the waveform creation cues in the cue buffer has exceeded the predetermined value to a certain degree, the quantity-to-be-formed SR may be set to an even greater value within such a predetermined limit that prevents one execution of this example of "modified tone generator processing I" from taking too much time.

At next step S142, a tone forming area for the quantity-to-be-formed SR starting at time ST (input time of one of MIDI messages for which tone generation has been completed last) is set in one of the output buffers other than those reserved in the initialization process, as at step S52 of FIG. 12.

At following steps S143 to S154 are executed the same operations as at steps S54 to S65 of FIG. 12. It is ascertained at step S155 what multiple of 10 milliseconds the set quantity-to-be-formed SR is, and then waveform cue is erased from the cue buffer in quantities corresponding to the ascertained multiple. For example, one waveform cue is erased if the quantity-to-be-formed SR is 10 milliseconds, and two waveform cues are erased if the quantity-to-be-formed SR is 20 milliseconds. The CPU 3 returns to the main routine after this.

As explained above, in the example of "modified tone generator processing I" of FIG. 19, the quantity-to-be-formed SR for one execution of "modified tone generator processing I" is set to be longer than 10 milliseconds within such a predetermined range assuring that too much time will not be consumed by the one execution of "modified tone generator processing I", when generation of the internal interrupt signal has failed consecutively many times. Such an arrangement not only achieves advantageous results as set forth in connection with the example of FIG. 18 but also can expedite the pending tone data formation when relatively many tone data are to be formed.

After completion of "modified tone generator processing I" at step S110 of FIG. 16, the CPU 3 goes to step S111 in order to display predetermined conditions on the panel screen and then loops back to step S103.

If triggering factor 4 has occurred as determined at step S105, the CPU 3 goes to steps S112 and S113 in order to execute "tone generator processing II" and visual presentation of predetermined conditions, which are similar to the counterparts of steps S10 and S11 of FIG. 8 except for "tone generator processing II" based on a reset request from the output device (step S78 of FIG. 13).

Figure 20:
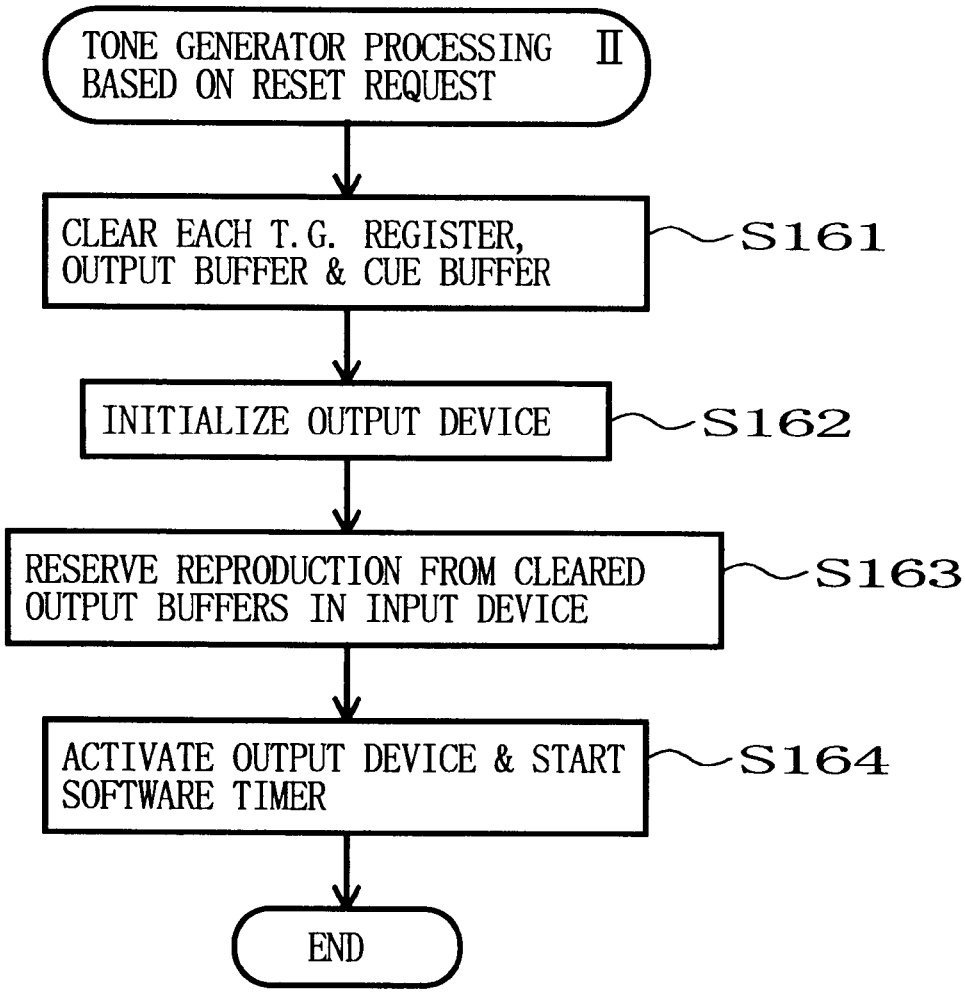
FIG. 20 is a flowchart illustrating another example of tone generator processing II executed by the CPU in the routine of FIG. 16 on the basis of a reset request from the DMA controller.

FIG. 20 is a flowchart illustrating an example of "tone generator processing II" executed on the basis of a reset request from the output device. At step S161, the CPU 3 clears all data from the cue buffer, tone generator registers and output buffers. At next steps S162 and S164, the same operations as at steps S92 to S94 of FIG. 15 are executed. Then, the CPU 3 returns to the main routine.

Referring back to FIG. 16, if triggering factor 5 or triggering factor 6 has occurred as determined at step S105, the CPU 3 goes to steps S114 and S115 or steps 116 and S117. Steps S114 and S115 execute operations which are similar to those of steps S12 and S13 of FIG. 8 executed when it is determined triggering factor 4 has occurred, and steps S116 and S117 execute operations which are similar to those of steps S14 and S15 of FIG. 8 executed when it is determined triggering factor 5 has occurred.

Modification 2

According to this modification, each time an internal interrupt signal is generated by the software timer, a quantity of tone data to be formed is set, as a function of a quantity of tone data left unformed up to that time, within such a predetermined range assuring that the tone generating processing will not take too much time, and processing is executed for forming tone data to reach the set quantity (this processing will hereinafter be called "further modified tone generator processing I"). By executing such "further modified tone generator processing I" in response to generation of an internal interrupt signal, the pending tone data formation is effected in a progressive manner. This scheme is similar to the main routine of FIG. 8 in that the tone generating processing is activated or triggered by an internal interrupt signal, but different from "tone generator processing I" of FIG. 12 in that the tone data are formed progressively at a plurality of times in stead of all the tone data being formed at one time; however, this scheme is similar to "modified tone generator processing I" executed in modification 1 described above. Therefore, Modification 2 prevents the CPU 3 from being exclusively used for "further modified tone generator processing I", so that the same advantageous results are achieved as in Modification 1. Modification 1 has to set the priority of the factor triggering "modified tone generator processing I" (i.e., waveform creation cue in the cue buffer) to be lower than that of the factor triggering the cue process (i.e., generation of an internal interrupt signal); however, in Modification 2, generation of an internal interrupt signal itself is the triggering factor for "further modified tone generator processing I" and hence the tone generation processing is more readily executable with higher priority.

Modification 2 will now be described in greater detail with reference to FIGS. 21 to 25.

In this modification, the CPU 3 executes a main routine which is the same as the main routine of FIG. 8 except that "further modified tone generator processing I" is executed in place of "tone generator processing I" of FIG. 8.

Figure 21:
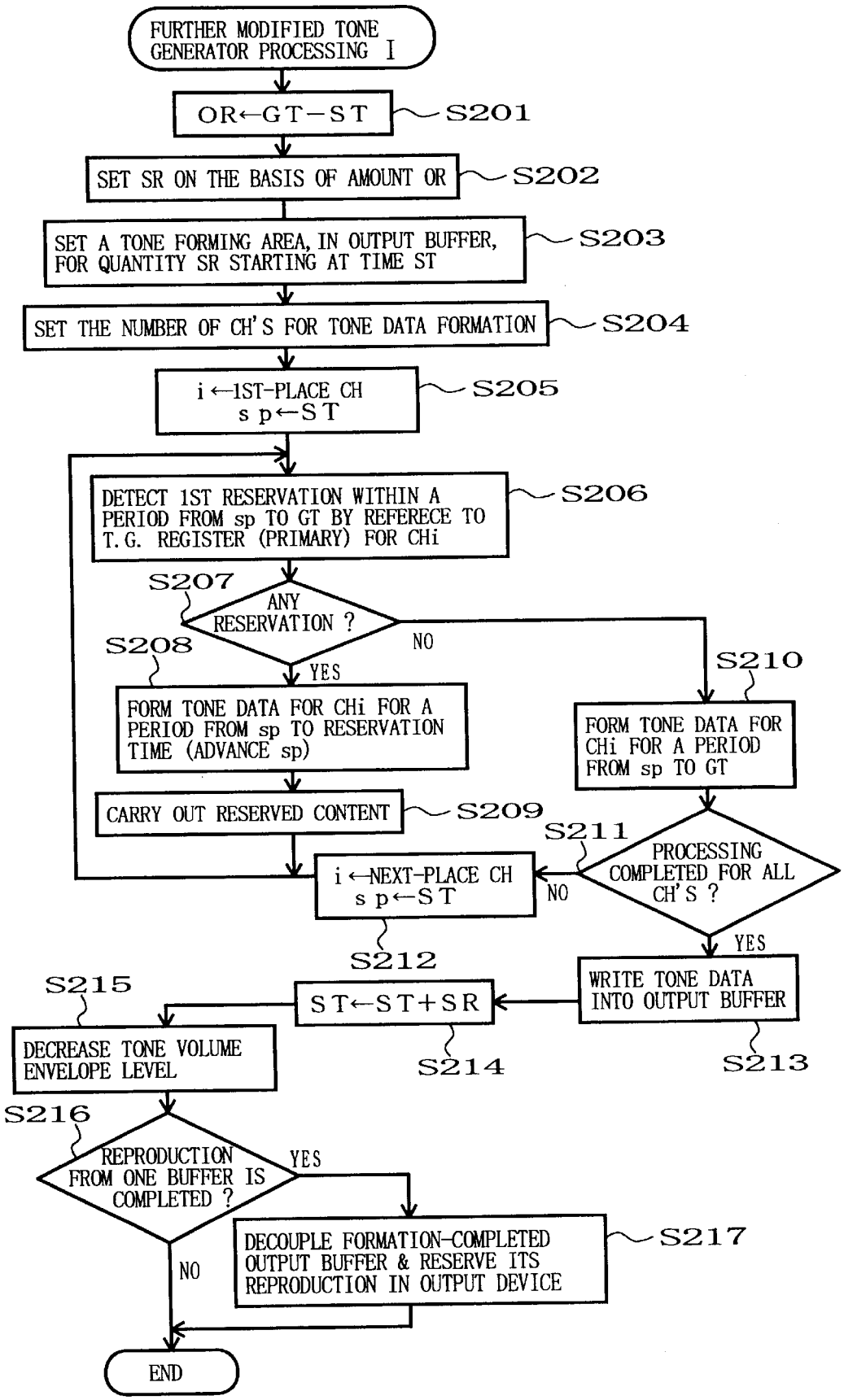
FIG. 21 is a flowchart illustrating an example of further modified tone generating processing I.

FIG. 21 is a flowchart illustrating an example of "further modified tone generating processing I". At first step S201, the CPU 3 subtracts, from a current time GT, an input time ST of one of MIDI messages for which tone generation has been completed last and sets the value of the subtraction result as a delay amount OR (this amount OR is represented in a time length corresponding to a quantity of left-unformed tone data). At next step S202, a quantity-to be-formed SR is set as a function of the delay amount OR.

Figure 22:
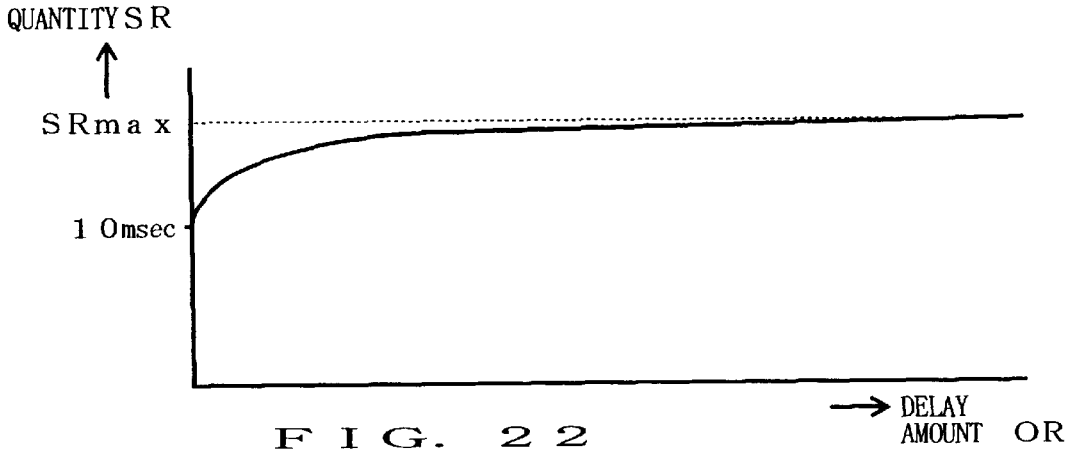
FIG. 22 is a graph illustrating an example of a characteristic curve when a quantity of tone data to be formed is set as a function of a delay amount.

FIG. 22 is a graph illustrating an example of a characteristic curve of that function. In this example, the quantity-to-be-formed SR is 10 milliseconds (corresponding to one tenth of the predetermined number of tone data to be written in one output buffer) when the delay amount OR is smaller than a predetermined value, but after the delay amount OR exceeds a given value, it successively increases as the amount OR increases in value. Then, after the quantity-to-be-formed SR reaches a predetermined upper limit value SRmax within such a range assuring that the tone generating processing will not take too much time, the quantity SR is maintained at the upper limit value SRmax irrespective of a further increase in the delay amount OR. The upper limit value SRmax may for example be 20 milliseconds or may be any other suitable value.

Figure 23:
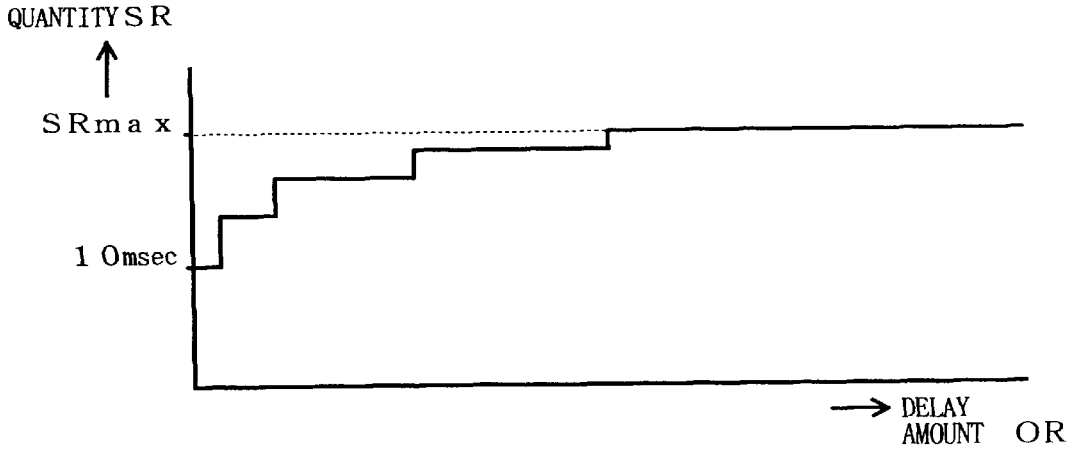
FIG. 23 is a graph illustrating another example of the characteristic curve.

FIG. 23 is a graph illustrating another example of the characteristic curve of the function. In this example, the quantity-to-be-formed SR is 10 milliseconds when the delay amount OR is smaller than a predetermined value, but after the delay amount OR exceeds a given value, it increases stepwise as the amount OR increases in value. Then, after the quantity-to-be-formed SR reaches a predetermined upper limit value SRmax within such a range assuring that the tone generating processing will not take too much time, the quantity SR is maintained at the upper limit value SRmax irrespective of a further increase in the delay amount OR.

Note that the quantity-to-be-formed SR set in the above-mentioned manner does not always take a value of an integral multiple of 10 milliseconds but may take a value of a multiple of 10 milliseconds having some fraction. As a result, the quantity of tone data that are formed by one execution of "further modified tone generating processing I" is not necessarily an integral multiple of one tenth of the predetermined number to be written in one output buffer as shown in FIG. 5 or 6, but may be a quantity corresponding to a multiple of 10 milliseconds having a fraction.

Figure 24:
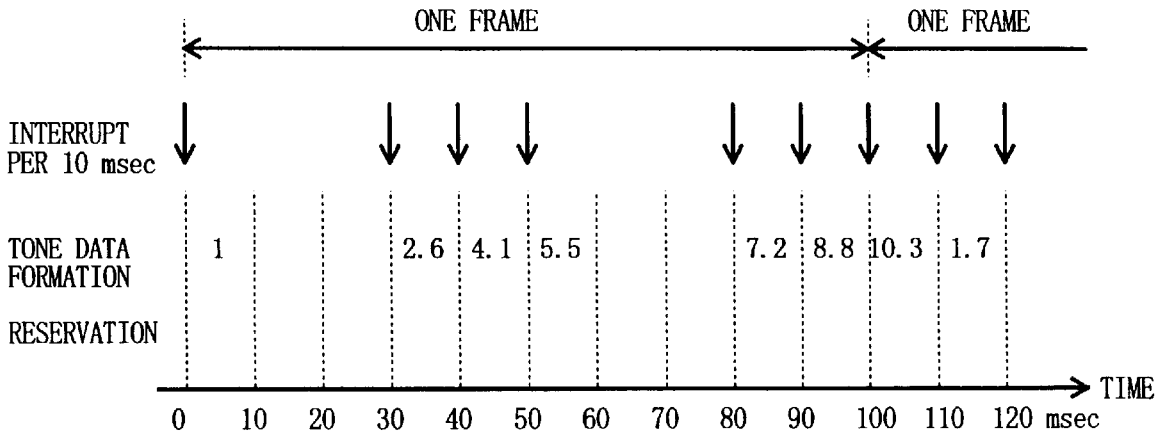
FIG. 24 is a diagram showing an example of a quantity of tone data formed in Modification 2 in connection with generation of internal interrupt signals.

FIG. 24 is a diagram showing an example of a quantity of tone data formed in Modification 2 in connection with generation of internal interrupt signals. In the example, a quantity of tone data corresponding to one tenth of the predetermined number to be written in one output buffer are formed in a frame at a first activating time (corresponding to 0th millisecond point in the illustrated example) when an internal interrupt signal is generated in the frame. No tone data is formed at second and third activating times (corresponding to 10th and 20th millisecond points in the figure) due to a failure of internal interrupt signal generation, and then, a specific quantity of tone data corresponding to 1.6/10 of the predetermined number to be written in one output buffer are formed at a fourth activating time (corresponding to 30th millisecond point) when another internal interrupt signal is generated. Thus, by the end of the fourth activating time, tone data have been formed up to a quantity corresponding to 2.6/10 of the predetermined number to be written in one output buffer, as denoted by "2.6" in the figure.

Then, another specific quantity of tone data corresponding to 1.5/10 of the predetermined number to be written in one output buffer are formed at a fifth activating time (corresponding to 40th millisecond point) when another internal interrupt signal is generated. Thus, by the end of the fifth activating time, tone data have been formed up to a quantity corresponding to 4.1/10 of the predetermined number to be written in one output buffer, as denoted by "4.1" in the figure. After this, still another specific quantity of tone data corresponding to 1.4/10 of the predetermined number to be written in one output buffer are formed at a sixth activating time (corresponding to 50th millisecond point) when still another internal interrupt signal is generated. Thus, by the end of the sixth activating time, tone data have been formed up to a quantity corresponding to 5.5/10 of the predetermined number to be written in one output buffer, as denoted by "5.5" in the figure.

No tone data is formed at seventh and eighth activating times (corresponding to 60th and 70th millisecond points) due to a failure of internal interrupt signal generation, and then, yet another specific quantity of tone data corresponding to 1.7/10 of the predetermined number to be written in one output buffer are formed at a ninth activating time (corresponding to 80th millisecond point) when yet another internal interrupt signal is generated. Thus, by the end of the ninth activating time, tone data have been belatedly formed up to a quantity corresponding to 7.2/10 of the predetermined number to be written in one output buffer, as de noted by "7.2" in the figure. After this, still another specific quantity of tone data corresponding to 1.6/10 of the predetermined number to be written in one output buffer are formed at a tenth activating time (90th millisecond point) when still another internal interrupt signal is generated. Thus, by the end of the tenth activating time, tone data have been formed, as a total for the frame, up to a quantity corresponding to 8.8/10 of the predetermined number to be written in one output buffer, as denoted by "8.8" in the figure.

Then, at a first activating time (100th millisecond point in the figure) of a next frame when another internal interrupt signal is generated, another quantity of tone data left unformed in the preceding frame corresponding to 1.2/10 of the predetermined number to be written in one output buffer are formed along with a specific quantity of tone data to be formed in the current frame corresponding to 0.3/10 of the predetermined number to be written in one output buffer, as denote d by "10.3" in the figure. After this, still another specific quantity of tone data corresponding to 1.4/10 of the predetermined number to be written in one output buffer for the current frame are formed at a second activating time (110th millisecond point) of the current frame when still another internal interrupt signal is generated. Thus, by the end of the second activating time, tone data have been formed up to a total quantity corresponding to 1.7/10 of the predetermined number to be written in one output buffer for the current frame, as denoted by "1.7" in the figure. After this, tone data will be formed in response to each internal interrupt signal until the total quantity reaches the above-mentioned upper limit value SRmax.

At step S203 following step S202, a tone forming area for the quantity-to-be-formed SR starting at time ST is set in one of the output buffers other than those reserved in the initialization process.

Figure 25:
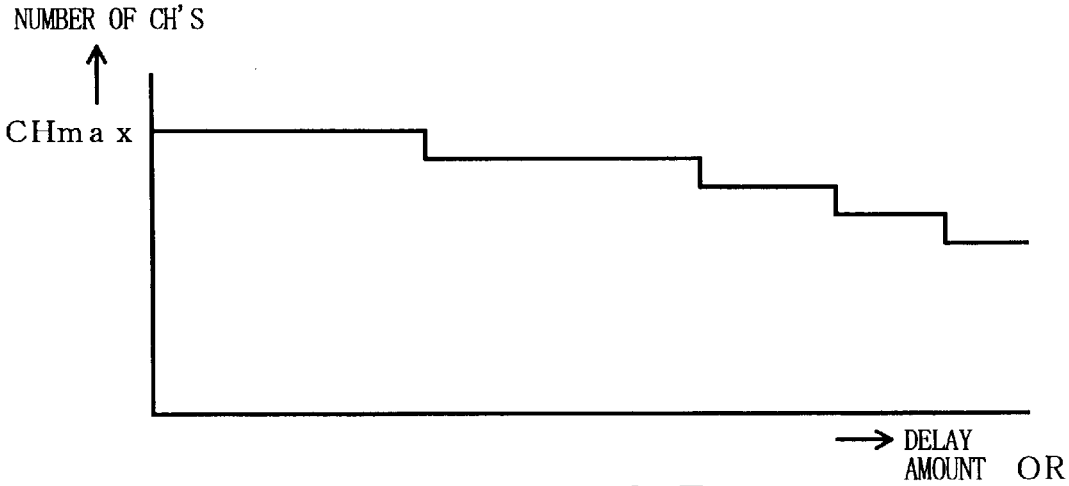
FIG. 25 is a graph illustrating an example of a characteristic curve of a function when the number of tone generating channels is set as a function of the delay amount.

Next step S204 sets the number of the tone generating channels to be used for forming tone data. The number of these tone generating channels may be set as a function of the delay amount OR. FIG. 25 is a graph illustrating an example of a characteristic curve of that function. According to this example, if the delay amount OR is below a predetermined value, then the number of the channels assigned in the note-on process of FIG. 10 CHmax is set as the number of the tone generating channels to be used for forming tone data. If the delay amount OR is not below a predetermined value, then the number of the tone generating channels to be used for forming tone data is set to be smaller than the number of the assigned channels CHmax, so that it is possible to reduce the necessary time for one execution of the tone generating processing.

Alternatively, the number of the tone generating channels to be used for forming tone data may be determined in a similar manner to step S53 of FIG. 12.

Referring back to FIG. 21, the same operations as at steps S53 to S63 of FIG. 12 are executed at steps S205 to S214 following step S204. At next step S215, the level of a tone volume envelope used for the tone generating channel assigned to the current note-on event is decreased toward zero. The same operations as at steps S64 and S65 of FIG. 12 are executed at steps S216 and S217, and then the CPU 3 returns to the main routine.

As described above, the computer music system of the present invention, even when the processing is executed on an operating system without a full multitask function, can reliably avoid a situation where the tone generation is hindered by a delay in the activation of the tone generator section due to an influence of other processing.

According to Measure 1 employed in the above-described embodiments, the predetermined number of samples of tone data are belatedly formed, for each frame, at some of the subsequent activating times. However, it does not necessarily mean that the formation of the predetermined number of samples of tone data needs to be completed within the same frame. Particularly, these embodiments can reserve a plurality of output buffers, having tone data written therein, for reproduction as shown in FIG. 7, and thus, even when arithmetic formation of the predetermined number of tone data is not completed within one frame, it is possible to perform arithmetic operations to form the remaining tone data in a subsequent frame. For instance, while in the example of FIG. 6, tone data left unformed in one frame due to a failure of internal interrupt signal generation at one or more activating times are formed by the end of the last activating time in the same frame, the arithmetic formation of these left-unformed tone data may be carried over to a next frame. For example, all tone data left unformed at four activating times of one frame need not necessarily be formed by the end of the tenth activating time of the same frame; instead, only the tone data left unformed at the seventh and eighth activating times may be formed by the end of the tenth activating time of the frame and the arithmetic forming operations of the other tone data left unformed at the ninth and tenth activating times may be carried over to one or more activating times of a subsequent frame where the internal interrupt signal generation occurs. In Modification 1 and Modification 2 described above, the arithmetic forming operations of tone data left unformed in one frame can be carried over to a next frame.

Further, according to the above-described embodiments, the control parameters for controlling the tone generator section and data indicative of a note-on event and occurrence time of the event are stored into the tone registers provided separately for the individual assigned tone generating channel through the MIDI process. Rather than being stored into the tone registers for the individual assigned tone generating channels, these control parameters and data may be sequentially written into a single storage area along with respective channel numbers of the assigned channels. In such a case, sequence data will first be created on the basis of supplied MIDI messages, and tone data will be formed on the basis of the sequence data.

Also, according to the above-described embodiments, the output buffer returned from the output device is coupled, through tone generator processing II, to the end of output buffers already possessed by the tone generator section, so that tone generator processing I forms and stores tone data into the intercoupled output buffers, sequentially from one output buffer to another. Alternatively, tone data may be formed and stored separately for each of the output buffers.

Furthermore, while the embodiments have been described above as making a reservation for reproduction from the four output buffers prior to the activation of the tone generator section, the number of the output buffers to be reserved for reproduction may of course be any other value than "four". Also, the number of the output buffers provided in the RAM 5 may be greater than the above-mentioned number of the output buffers to be reserved for reproduction.

Moreover, while the embodiments have been described above as executing all of Measure 1, Measure 2, Measure 3 and Measure 4 together, the tone generation can be prevented from being hindered by a delay in the activation of the tone generator section even where each of these measures is executed independently of the other measures. Only one of these measures or an appropriate combination of two or three of the measures may be executed.

In addition, while in the described embodiments, the present invention is applied to the software tone generator where the CPU is programmed to execute tone generating processing based on the waveform memory method, the present invention may be applied to a software tone generator where the CPU is programmed to execute tone the generating processing based on another suitable method such as the FM synthesis method.

Moreover, while in the described embodiments, the present invention is applied to the software tone generator where the CPU of a personal computer is programmed to execute tone generating processing, the present invention may be applied to a software tone generator where the CPU loaded in a dedicated tone generating device is programmed to execute the tone generating processing.

The above-described embodiments achieve superior benefits as set forth below.

According to one embodiment, even when the tone generating processing fails to be activated at some of the activating times, the predetermined number of samples of tone data can be belatedly formed within the predetermined time period, by the tone data forming operations being effected only at the other activating times when the tone generating processing is actually activated. According to another embodiment, when new tone generating processing based on newly supplied performance information is assigned to any of such channels still in use for current tone generating processing and hence unavailable for the new tone generating processing, the new tone generating processing in the channel can be immediately prepared.

According to still another embodiment, an unwanted break in a stream of generated tones can be reliably avoided with an expanded tolerable range of time delay in the activation the tone generating processing. According to still another embodiment, if reproduction from any output buffer is not reserved within a predetermined time period, the tone generating processing is renewed so that even when the reproduction reservation can not be made in time to cause a temporary disturbance in the tone generation, stable tone generation can be promptly restored and hence accompanying noise can be minimized. According to still another embodiment, a predetermined number of samples of tone data can be formed within the predetermined time period just by the tone data forming operations being effected only when the tone generating processing is actually activated, while maintaining the tolerable range of time delay in activating the tone generating processing.

With the arrangements having been described thus far, the present invention can effectively prevent a hindrance to tone generation in such applications where the tone generating processing is executed on an operating system having no full multitask function.

What is claimed is:

1. A tone generating device comprising:

a supply unit for supplying performance information;

a storage unit for storing therein a plurality of programs including a tone generating program; and a general-purpose arithmetic processing unit capable of concurrently executing the programs stored in said storage unit in a parallel manner, said arithmetic processing unit causing a plurality of internal interrupt signals to be generated within a predetermined time period and activating the tone generating program to generate tone data based on the performance information that is supplied by said supply unit in response to the internal interrupt signals, wherein the tone generating program activated by said arithmetic processing unit includes an adjusting mechanism for variably adjusting an amount of a tone waveform to be generated, in such a manner that a predetermined number of samples of tone data can be cumulatively formed within the predetermined time period by tone data forming operations being effected only when the tone generating program is actually activated by said arithmetic processing unit.

2. A tone generating device as claimed in claim 1 wherein if the predetermined number of samples of tone data can not be formed, by the tone data forming operations alone effected only when the tone generating program is actually activated, for every tone generating channel that is designated by the performance information for tone generation, said adjusting mechanism reduces a specific number of the tone generating channels to be used for forming the tone data so as to secure formation of the predetermined number of samples of tone data.

3. A tone generating method for causing a general-purpose arithmetic processing unit to generate a tone on the basis of performance information by executing one of a plurality of programs which are concurrently executable thereby, said method comprising:

a first step of generating internal interrupt signals to activate tone generating processing a plurality of times within a predetermined time period;

a second step of designating an amount of a tone waveform to be generated by the tone generating processing, in such a manner that a predetermined number of samples of tone data can be cumulatively formed within the predetermined time period by tone data forming operations being effected only when the tone generating processing is actually activated in response to the internal interrupt signals; and a third step of executing the tone generating processing in response to the internal interrupt signals, so as to form tone data corresponding to the amount of a tone waveform designated by said second step.

4. A tone generating method as claimed in claim 3 wherein if the predetermined number of samples of tone data can not be formed, by the tone data forming operations alone effected only when the tone generating processing is actually activated, for every tone generating channel assigned to the tone generating processing, said third step reduces a specific number of the tone generating channels to be used for forming the tone data so as to secure formation of the predetermined number of samples of tone data.

5. A tone generating device comprising:

a supply unit for supplying performance information;

a first register for, when tone generating processing based on the performance information is assigned to an unused tone generating channel, storing therein a parameter for controlling the tone generating processing;

a second register for, when new tone generating processing based on other performance information is assigned to the tone generating channel while said channel is not available for the new tone generating processing, storing therein a parameter for controlling the new tone generating processing;

a selecting unit for selecting said first register before a predetermined time point to start the new tone generating processing and selecting said second register after the predetermined time point; and a tone generating unit for generating tone data in the tone generating channel by use of one of said first and second registers selected by said selecting unit.

6. A tone generating method for causing general-purpose arithmetic processing unit to execute tone generating processing on the basis of supplied performance information, said method comprising:

a first step of assigning tone generating processing to an unused tone generating channel and storing a parameter for controlling the tone generating processing into a first register;

a second step of assigning new tone generating processing to the tone generating channel while said channel is not available for the new tone generating processing, storing a parameter for controlling the new tone generating processing into a second register;

a third step of selecting said first register before a predetermined time point to start the new tone generating processing and selecting said second register after the predetermined time point; and a fourth step of generating tone data in the tone generating channel by use of one of said first and second registers selected by said third step.

7. A tone generating device comprising:

a supply unit for supplying performance information;

a plurality of output buffers for writing therein tone data;

a reproducing unit for sequentially reproducing the tone data from one of the output buffers which has been reserved for subsequent tone data reproduction;

a storage unit for storing therein a plurality of programs including a tone generating program; and a general-purpose arithmetic processing unit capable of concurrently executing the programs stored in said storage unit in a parallel manner, said arithmetic processing unit activating the tone generating program in response to internal interrupt signals generated at predetermined time intervals, wherein said tone generating program contains program code mechanisms to implement a tone generating process for generating tone data on the basis of the performance information that is supplied by said supply unit prior to reproduction timing of said reproducing unit, a writing process for writing the generated tone data into another of said output buffers that is not reserved, and a reserving process for reserving said other output buffer, having the tone data written therein, for subsequent tone data reproduction by said reproducing unit, and wherein said generating process receives the performance information at timing that precedes the reproduction timing by a time corresponding to a total capacity of said output buffers, and two or more of said output buffers can be simultaneously reserved by said reserving process.

8. A tone generating method for causing a general-purpose arithmetic processing unit to generate a tone on the basis of performance information by executing one of a plurality of programs which are concurrently executable thereby, said method comprising:

a reproduction step of sequentially reproducing tone data from a specific one of a plurality of output buffers which has been reserved for subsequent tone data reproduction; and a generation step of, in response to internal interrupt signals generated at predetermined time intervals, generating tone data on the basis of performance information that is supplied prior to reproduction timing of said reproduction step, writing the generated tone data into another of said output buffers than said specific output buffer, and reserving said other output buffer for subsequent tone data reproduction by the reproduction step, wherein the generation step receives the performance information at timing that precedes the reproduction timing by a time corresponding to a total capacity of said output buffers, and two or more of said output buffers can be simultaneously reserved.

9. A tone generating device comprising:

a supply unit for supplying performance information;

a plurality of output buffers for writing therein tone data;

a reproducing unit for sequentially reproducing the tone data stored in one of the output buffers which has been reserved for subsequent tone data reproduction;

a storage unit for storing therein a plurality of programs including a tone generating program; and a general-purpose arithmetic processing unit capable of concurrently executing the programs stored in said storage unit in a parallel manner, said arithmetic processing unit activating the tone generating program in response to internal interrupt signals generated at predetermined time intervals, wherein said tone generating program contains program code mechanisms to implement a tone generating process for generating tone data on the basis of the performance information that is supplied by said supply unit prior to reproduction timing of said reproducing unit, a writing process for writing the generated tone data into another of said output buffers that is not reserved, and a reserving process for reserving said other output buffer, having the tone data written therein, for subsequent tone data reproduction by said reproducing unit, and wherein if tone data for writing into one of said output buffers to be next reserved has not yet been prepared at a time point when said reproducing unit has reproduced all the tone data from the reserved output buffer, said generating process discontinues generation of tone data that should have been completed by said time point and then newly starts generation of other tone data to be formed a predetermined time after said time point.

10. A tone generating method for causing a general-purpose arithmetic processing unit to generate a tone on the basis of performance information by executing one of a plurality of programs which are concurrently executable thereby, said method comprising:

a reproduction step of sequentially reproducing tone data stored in a specific one of a plurality of output buffers which has been reserved for subsequent tone data reproduction; and a generation step of, in response to internal interrupt signals generated at predetermined time intervals, generating tone data on the basis of performance information that is supplied prior to reproduction timing of said reproduction step, writing the generated tone data into another of said output buffers than said specific output buffer, and reserving said other output buffer for subsequent tone data reproduction by said reproduction step, wherein if tone data for writing into one of said output buffers to be next reserved has not yet been prepared at a time point when said reproduction step has reproduced all the tone data from the reserved output buffer, said generating process discontinues generation of tone data that should have been completed by said time point and then newly starts generation of the tone data to be formed a predetermined time after said time point.

11. A tone generating device comprising:

a supply unit for supplying performance information;

a plurality of output buffers for writing therein tone data;

a reproducing unit for sequentially reproducing the tone data stored in one of the output buffers which has been reserved for subsequent tone data reproduction;

a storage unit for storing therein a plurality of programs including a tone generating program;

a general-purpose arithmetic processing unit capable of concurrently executing the programs stored in said storage unit in a parallel manner, said arithmetic processing unit causing a plurality of internal interrupt signals to be generated within a predetermined time period and activating the tone generating program to generate tone data based on the performance information that is supplied by said supply unit in response to the internal interrupt signals;

wherein said tone generating program contains program code mechanisms to implement a tone generating process for generating tone data on the basis of performance information that is supplied by said supply unit prior to reproduction timing of said reproducing unit, a writing process for writing the generated tone data into another of said output buffers that has not been reserved, and a reserving process for reserving said other output buffer, having the tone data written therein, for subsequent tone data reproduction by said reproducing unit, and wherein on the basis of a specific number of samples of tone data previously generatable at a time of activation of said tone generating process, determines a total number of samples of tone data to be generated.

12. A tone generating device as claimed in claim 11 wherein on the basis of the specific number of previously generatable samples of tone data, said tone generating process determines the total number of samples of tone data to be generated within a range not exceeding a predetermined upper limit.

13. A tone generating method for causing a general-purpose arithmetic processing unit to generate a tone on the basis of performance information by executing one of a plurality of programs which are concurrently executable thereby, said method comprising:

a reproduction step of sequentially reproducing tone data stored in a specific one of a plurality of output buffers which is reserved for subsequent tone data reproduction; and a generation step of, in response to internal interrupt signals generated at predetermined time intervals, generating tone data on the basis of performance information that is supplied prior to reproduction timing of the reproduction step, writing the generated tone data into another of said output buffers than said specific output buffer, and reserving said other output buffer for subsequent tone data reproduction by said reproduction step, wherein on the basis of a specific number of samples of tone data previously generatable at a time of activation of said tone generating process, determines a total number of samples of tone data to be generated.

14. A tone generating method as claimed in claim 13 wherein on the basis of the specific number of previously generatable samples of tone data, said generation step determines the total number of samples of tone data to be generated within a range not exceeding a predetermined upper limit.

15. A machine readable recording medium containing a group of instructions to cause said machine to implement a method for causing general-purpose arithmetic processing unit to generate a tone on the basis of performance information by executing one of a plurality of programs which are concurrently executable thereby, said method comprising:

a first step of generating internal interrupt signals to activate tone generating processing a plurality of times within a predetermined time period;

a second step of designating an amount of a tone waveform to be generated by the tone generating processing, in such a manner that a predetermined number of samples of tone data can be cumulatively formed within the predetermined time period by tone data forming operations being effected only when the tone generating processing is actually activated in response to the internal interrupt signals; and a third step of executing the tone generating processing in response to the internal interrupt signals, so as to form tone data corresponding to the amount of a tone waveform designated by said second step.

16. A machine readable recording medium containing a group of instructions to cause said machine to implement a method for causing general-purpose arithmetic processing unit to execute tone generating processing on the basis of supplied performance information, said method comprising:

a first step of assigning tone generating processing to an unused tone generating channel and storing a parameter for controlling the tone generating processing into a first register;

a second step of assigning new tone generating processing to the tone generating channel while said channel is not available for the new tone generating processing, storing a parameter for controlling the new tone generating processing into a second register;

a third step of selecting said first register before a predetermined time point to start the new tone generating processing and selecting said second register after the predetermined time point; and a fourth step of generating tone data in the tone generating channel by use of one of said first and second registers selected by said third step.

17. A machine readable recording medium containing a group of instructions to cause said machine to implement a method for causing general-purpose arithmetic processing unit to generate a tone on the basis of performance information by executing one of a plurality of programs which are concurrently executable thereby, said method comprising:

a reproduction step of sequentially reproducing tone data from a specific one of a plurality of output buffers which has been reserved for subsequent tone data reproduction; and a generation step of, in response to internal interrupt signals generated at predetermined time intervals, generating tone data on the basis of performance information that is supplied prior to reproduction timing of said reproduction step, writing the generated tone data into another of said output buffers than said specific output buffer, and reserving said other output buffer for subsequent tone data reproduction by the reproduction step, wherein the generation step receives the performance information at timing that precedes the reproduction timing by a time corresponding to a total capacity of said output buffers, and two or more of said output buffers can be simultaneously reserved.

18. A machine readable recording medium containing a group of instructions to cause said machine to implement a method for causing general-purpose arithmetic processing unit to generate a tone on the basis of performance information by executing one of a plurality of programs which are concurrently executable thereby, said method comprising:

a reproduction step of sequentially reproducing tone data stored in a specific one of a plurality of output buffers which has been reserved for subsequent tone data reproduction; and a generation step of, in response to internal interrupt signals generated at predetermined time intervals, generating tone data on the basis of performance information that is supplied prior to reproduction timing of said reproduction step, writing the generated tone data into another of said output buffers than said specific output buffer, and reserving said other output buffer for subsequent tone data reproduction by said reproduction step, where if tone data for writing into one of said output buffers to be next reserved has not yet been prepared at a time point when said reproduction step has reproduced all the tone data form the reserved output buffer, said generating process discontinues generation of tone data that should have been completed by said time point and then newly starts generation of other tone data to be formed a predetermined time after said time point.

19. A machine readable recording medium containing a group of instructions to cause said machine to implement a method for causing general-purpose arithmetic processing unit to generate a tone on the basis of performance information by executing one of a plurality of programs which are concurrently executable thereby, said method comprising:

a reproduction step of sequentially reproducing tone data stored in a specific one of a plurality of output buffers which is reserved for subsequent tone data reproduction; and a generation step of, in response to internal interrupt signals generated at predetermined time intervals, generating tone data on the basis of performance information that is supplied prior to reproduction timing of the reproduction step, writing the generated tone data into another of said output buffers than said specific output buffer, and reserving said other output buffer for subsequent tone data reproduction by said reproduction step, wherein on the basis of a specific number of samples of tone data previously generatable at a time of activation of said tone generating process, determines a total number of samples of tone data to be generated.

* * * * *